US005578439A

United States Patent [19]

Inagaki

[11] Patent Number: 5,578,439

[45] Date of Patent: Nov. 26, 1996

[54] SILVER HALIDE PHOTOGRAPHIC MATERIAL

[75] Inventor: Yoshio Inagaki, Kanagawa, Japan

[73] Assignee: Fuji Photo Film Co., Ltd., Kanagawa, Japan

[21] Appl. No.: 506,732

[22] Filed: Jul. 26, 1995

[30] Foreign Application Priority Data

Jul. 29, 1994 [JP] Japan ..... 6-196254

[51] Int. Cl.[6] ..... G03C 1/12

[52] U.S. Cl. ..... 430/576; 430/577; 430/578; 430/579; 430/580; 430/581; 430/582; 430/583; 430/584; 430/585; 430/586; 430/587; 430/588

[58] Field of Search ..... 430/576, 577, 430/578, 579, 580–588, 590–595

[56] References Cited

U.S. PATENT DOCUMENTS 4,945,038 7/1990 Momoki et al. ..... 430/581

*Primary Examiner*—Thorl Chea

*Attorney, Agent, or Firm*—Sughrue, Mion, Zinn, Macpeak & Seas

[57] ABSTRACT

A silver halide photographic material is described, which contains the methine compound represented by the following formula (I):

(I)

wherein $Z^1$ represents a nonmetal atomic group necessary for completing a 5- or 6-membered heterocyclic ring which may be condensed; $R^1$ represents an aliphatic or aromatic group which may be substituted; $G^1$ represents a hydroxyl group, an amino group, an aliphatic or aromatic primary amino group, a hydroxyamino group, an alkoxyamino group, an acylamino group, or an aliphatic or aromatic sulfonamido group; $G^2$ is a group substituted at the position adjacent to G and is a group represented by $T^2$—C(=$T^1$)—; =$T^1$ represents =O, =NH, =NOH, an alkoxyimino group, an aliphatic or aromatic imino group, an acylimino group, or an aliphatic or aromatic sulfonylimino group; $T^2$ represents a hydrogen atom, an alkyl group, an aryl group, an alkoxy group, an aryloxy group, an amino group, a primary or secondary amino group, a carbonamido group, an aliphatic or aromatic sulfonamido group or a ureido group; p represents 0 or 1; and Q represents a residue for forming a methine dye.

4 Claims, No Drawings

SILVER HALIDE PHOTOGRAPHIC MATERIAL

FIELD OF THE INVENTION

The present invention relates to a silver halide photographic material containing a methine compound.

BACKGROUND OF THE INVENTION

It has been required in recent years to shorten the processing time of image formation processing of silver halide photographic materials. However, if the processing time is shortened, sufficient time required for the decolorization reaction of the dyes, sensitizing dyes or desensitizing dyes contained in photographic materials, or sufficient time for them to be eluted from the photographic materials cannot be secured. As a result of this, a problem arises such that a residual color becomes conspicuous due to the residue of these dyes, sensitizing dyes or desensitizing dyes.

The improvement of processing solutions for reducing a residual color has been studied. The following methods as disclosed in *Research Disclosure,* Vol. 207, No. 20733 (July, 1981) are known methods to cope with this problem, for example, (a) a method of adding a water-soluble stilbene compound, a nonionic surfactant, or a mixture of them, to a developing solution, (b) a method of destroying dyes by processing photographic elements after bleaching and fixing with an oxidizing agent, and (c) a method of using a persulfuric acid bleaching bath as a bleaching bath. However, conspicuous improvement in residual colors cannot be achieved by these methods because these are not to positively accelerate the elution of sensitizing dyes and dyes.

On the other hand, the introduction of sulfonic acid groups to dyes or dyestuffs has been conventionally conducted to improve the water solubility of dyes or sensitizing dyes for the purpose of increasing the efficiency of elution, and the dyes having acylsulfonamido groups as disclosed in U.S. Pat. No. 5,290,676, and the dyes having hydrophilic aromatic groups as disclosed in EP-A-599381, EP-A-599382, EP-A-599383 and EP-A-599384 are proposed in recent years.

However, the syntheses of these dyes are not necessarily easy. Even if residual colors can be effectively improved by these methods, there still exists a problem such that various performances imposed on the dyes and the sensitizing dyes such as sensitivity, spectral characteristics, aggregation property and adsorbability to silver halide grains cannot often be satisfied. Therefore, other means for improving residual colors have been desired.

SUMMARY OF THE INVENTION

An object of the present invention is to provide a silver halide photographic material which is accompanied by less residual colors due to spectral sensitizing dyes after image forming processing using a novel methine compound without imparing sensitivity, spectral sensitivity distribution and storage stability required of photographic materials.

The above object of the present invention has been attained by the following means.

(1) A silver halide photographic material which contains at least one compound represented by the following formula (I):

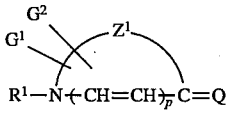

(I)

wherein $Z^1$ represents a nonmetal atomic group necessary for completing a 5- or 6-membered heterocyclic ring which may be condensed; $R^1$ represents an aliphatic or aromatic group which may be substituted; $G^1$ represents a hydroxyl group, an amino group, an aliphatic or aromatic primary amino group, a hydroxyamino group, an alkoxyamino group, an acylamino group, or an aliphatic or aromatic sulfonamido group; $G^2$ is a group substituted at the position adjacent to $G^1$ and is a group represented by $T^2$—C(=$T^1$)—; =$T^1$ represents =O, =NH, =NOH, an alkoxyimino group, an aliphatic or aromatic imino group, an acylimino group, or an aliphatic or aromatic sulfonylimino group; $T^2$ represents a hydrogen atom, an alkyl group, an aryl group, an alkoxy group, an aryloxy group, an amino group, a primary or secondary amino group, a carbonamido group, an aliphatic or aromatic sulfonamido group or a ureido group; p represents 0 or 1; and Q represents a residue for forming a methine dye.

(2) A silver halide photographic material as described in above (1), wherein Q is represented by formulae (II), (III) or (IV):

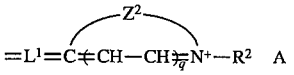

(II)

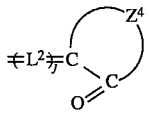

(III)

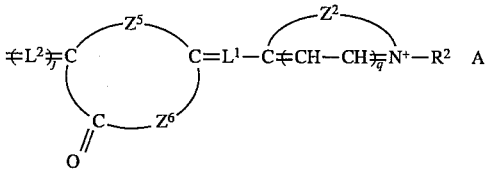

(IV)

wherein $Z^2$ represents a nonmetal atomic group necessary for completing a 5- or 6-membered heterocyclic ring which may be condensed; $Z^4$ represents a nonmetal atomic group necessary for forming a 5- or 6-membered ring together with (C—C=O); $Z^5$ and $Z^6$ represent a nonmetal atomic group necessary for completing a 5- or 6-membered ring together with (C—C=O); q represents 0 or 1; $L^1$ represents a methine group which may be substituted, or a trivalent group obtained by making 3, 5 or 7 methine groups link by a conjugated double bond; $L^2$ represents a tetravalent group obtained by making 2, 4 or 6 methine groups link to form a conjugated double bond which may be substituted; $R^2$ represents an aromatic group which may be substituted or an aliphatic group which may be substituted; j represents 0 or 1; A represents a counter ion, in the case of necessity.

(3) A silver halide photographic material as described in above (1) or (2), wherein formula (I) is represented by the following formula (I-A):

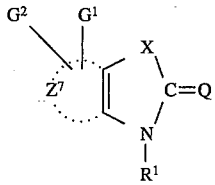

(I-A)

wherein $R^1$, Q, $G^1$ and $G^2$ each has the same meaning as in formula (I); X represents —S—, >N—$R^3$ or —O—; $R^3$ has the same meaning as $R^1$; $Z^7$ represents an atomic group necessary for forming a benzene ring or a naphthalene ring.

DETAILED DESCRIPTION OF THE INVENTION

The present invention is described in detail below.

Q represents a residue for forming a methine dye. The methine dyes completed by the residue represented by Q include a cyanine dye, a merocyanine dye, an arylidene dye, a cinnamylidene dye, or a polynuclear dye such as a rhodacyanine dye which is a complex of these dyes.

Q in formula (I) is preferably represented by formula (II), (III) or (IV).

Formula (I) is preferably represented by formula (I-A).

$Z^1$ represents a nonmetal atomic group necessary for completing a 5- or 6-membered heterocyclic ring which may be condensed, and the nonmetal atomic group on the ring may be substituted.

Examples of the heterocyclic ring completed by $Z^1$ include a benzothiazole nucleus, a benzoxazole nucleus, a benzoselenazole nucleus, a benzotellurazole nucleus, a quinoline nucleus, a benzimidazole nucleus, a thiazoline nucleus, an indoline nucleus, an oxadiazole nucleus, a thiazole nucleus and an imidazole nucleus, preferably a benzothiazole nucleus, a benzoxazole nucleus, a benzimidazole nucleus, a benzoselenazole nucleus, and a quinoline nucleus, and particularly preferably a benzothiazole nucleus and a benzoxazole nucleus.

Examples of the substituents for $Z^1$ on the ring, other than $G^1$ and $G^2$, include a halogen atom (e.g., F, Cl, Br, I), a cyano group, an alkoxy group (e.g., methoxy, ethoxy, methoxyethoxy), an aryloxy group (e.g., phenoxy), an alkyl group (e.g., methyl, ethyl, cyclopropyl, cyclohexyl, trifluoromethyl, methoxyethyl, allyl, benzyl), an alkylthio group (e.g., methylthio, ethylthio), an alkenyl group (e.g., vinyl, 1-propenyl), an aryl group (e.g., phenyl, thienyl, toluyl, chlorophenyl).

p represents 0 or 1, preferably 0.

$R^1$ represents an aliphatic or aromatic group which may be substituted. The carbon atom number of the aliphatic group is preferably 1 to 6, for example, a methyl group, an ethyl group, an n-propyl group, and an n-butyl group. The carbon atom number of the aromatic group is preferably from 6 to 16, for example, a phenyl group and a naphthyl group. The aliphatic or aromatic group represented by $R^1$ may have an acidic group or a group corresponding to the salt thereof as a substituent. Examples of the acidic group include, in addition to a sulfo group and a carboxyl group, a group which can form anion by releasing proton such as imido group, for example, —CO—NH—$SO_2$—, —CO—NH—CO—, and examples of $R^1$ substituted with these groups include, for example, a 2-sulfoethyl group, a 3-sulfopropyl group, a 3-sulfobutyl group, a 4-sulfobutyl group, a 3-methyl-4-sulfobutyl group, and —$CH_2CONHSO_2CH_3$, preferably a 2-sulfoethyl group, a 3-sulfopropyl group, a 3-sulfobutyl group, a 4-sulfobutyl group, and a 3-methyl-4-sulfobutyl group, and particularly preferably a 2-sulfoethyl group, a 3-sulfopropyl group and a 4-sulfobutyl group. Examples of other preferred substituents include a comparatively hydrophilic group such as a hydroxyl group, a carbonamido group, a carbamoyl group, a sulfonamido group, a sulfamoyl group, and an alkoxy group. The group represented by $R^1$ may have a plurality of groups at the same time, for example, a combination of a sulfo group and a hydroxyl group.

$G^1$ represents a hydroxyl group, an amino group, an aliphatic or aromatic primary amino group, a hydroxyamino group, an alkoxyamino group, an acylamino group or an aliphatic or aromatic sulfonamido group.

The aliphatic primary amino group represented by $G^1$ is preferably an alkylamino group having from 1 to 8 carbon atoms, and the alkyl moiety may have a substituent, and examples of the substituents include a halogen atom (e.g., F, Cl, Br, I), a cyano group, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The aromatic primary amino group represented by $G^1$ is preferably a phenyl group having from 6 to 8 carbon atoms which may be substituted, and examples of the substituents include a halogen atom (e.g., F, Cl, Br, I), a cyano group, an alkyl group having from 1 to 4 carbon atoms, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The alkyl moiety of the alkoxyamino group represented by $G^1$ is preferably an alkyl group having from 1 to 8 carbon atoms which may be substituted, and examples of the substituents include a halogen atom (e.g., F, Cl, Br, I), a cyano group, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The acyl moiety of the acylamino group represented by $G^1$ is preferably a formyl group, an aliphatic acyl group having from 2 to 8 carbon atoms or an aromatic acyl group, which may be substituted, and examples of the substituents include a halogen atom (e.g., F, Cl, Br, I), a cyano group, an alkyl group having from 1 to 4 carbon atoms, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The aliphatic sulfonamido group represented by $G^1$ is preferably an alkanesulfonamido group having from 1 to 8 carbon atoms which may be substituted, and examples of the substituents include a halogen atom (e.g., F, Cl, Br, I), a cyano group, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The aromatic sulfonamido group represented by $G^1$ is preferably a benzenesulfonamido group having from 6 to 8 carbon atoms which may be substituted, and examples of the substituents include a halogen atom (e.g., F, Cl, Br, I), a cyano group, an alkyl group having from 1 to 4 carbon atoms, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

A particularly preferred group as $G^1$ is a hydroxy group.

$G^2$ is a group substituted at the position adjacent to $G^1$ and is a group represented by $T^2$—C(=$T^1$)—; =$T^1$ represents =O, =NH, =NOH, an alkoxyimino group, an aliphatic or aromatic imino group, an acylimino group, or an aliphatic or aromatic sulfonylimino group; $T^2$ represents a hydrogen atom, an alkyl group, an aryl group, an alkoxy group, an aryloxy group, an amino group, a primary or secondary amino group, a carbonamido group, an aliphatic or aromatic sulfonamido group or a ureido group.

The alkyl moiety of the alkoxyimino group represented by $T^1$ is preferably an alkyl group having from 1 to 8 carbon atoms which may be substituted, and examples of the substituents include a halogen atom (e.g., F, Cl, Br, I), a cyano group, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The aliphatic imino group represented by $T^1$ is preferably an N-alkylimino group which may be substituted, and examples of the substituents include a halogen atom (e.g., F, Cl, Br, I), a cyano group, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The aromatic imino group represented by $T^1$ is preferably an N-phenylimino group having from 6 to 8 carbon atoms which may be substituted, and examples of the substituents include a halogen atom (e.g., F, Cl, Br, I), a cyano group, an alkyl group having from 1 to 4 carbon atoms, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The acylimino group represented by $T^1$ is preferably an aliphatic acylimino group having from 2 to 8 carbon atoms or an aromatic acylimino group, which may be substituted, and examples of the substituents include a halogen atom (e.g., F, Cl, Br, I), a cyano group, an alkyl group having from 1 to 4 carbon atoms, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The aliphatic sulfonylimino group represented by $T^1$ is preferably an alkanesulfonylimino group having from 1 to 8 carbon atoms which may be substituted, and examples of the substituents include a halogen atom (e.g., F, Cl, Br, I), a cyano group, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The aromatic sulfonylimino group represented by $T^1$ is preferably a benzenesulfonylimino group having from 6 to 8 carbon atoms which may be substituted, and examples of the substituents include a halogen atom (e.g., F, Cl, Br, I), a cyano group, an alkyl group having from 1 to 4 carbon atoms, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The alkyl group represented by $T^2$ is preferably an alkyl group having from 1 to 8 carbon atoms which may be substituted, and examples of the substituents include a halogen atom (e.g., F, Cl, Br, I), a cyano group, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The aryl group represented by $T^2$ is preferably a phenyl group having from 6 to 8 carbon atoms which may be substituted, and examples of the substituents include a halogen atom (e.g., F, Cl, Br, I), a cyano group, an alkyl group having from 1 to 4 carbon atoms, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The alkoxy group represented by $T^2$ is preferably an alkoxy group having from 1 to 8 carbon atoms which may be substituted, and examples of the substituents include a halogen atom (e.g., F, Cl, Br, I), a cyano group, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The aryloxy group represented by $T^2$ is a phenoxy group having from 6 to 8 carbon atoms which may be substituted, and examples of the substituents include a halogen atom (e.g., F, Cl, Br, I), a cyano group, an alkyl group having from 1 to 4 carbon atoms, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The substituent for the primary or secondary amino group represented by $T^2$ is preferably an alkyl group having from 1 to 8 carbon atoms which may be substituted or a phenyl group having from 6 to 8 carbon atoms which may be substituted, and examples of the substituents for these alkyl and phenyl groups include a halogen atom (e.g., F, Cl, Br, I), a cyano group, an alkyl group having from 1 to 4 carbon atoms, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The carbonamido group represented by $T^2$ is preferably an aliphatic carbonamido group having from 2 to 8 carbon atoms or an aromatic carbonamido group, which may be substituted, and examples of the substituents include a halogen atom (e.g., F, Cl, Br, I), a cyano group, an alkyl group having from 1 to 4 carbon atoms, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The aliphatic sulfonamido group represented by $T^2$ is preferably an alkanesulfonamido group having from 1 to 8 carbon atoms which may be substituted, and examples of the substituents include a halogen atom (e.g., F, Cl, Br, I), a cyano group, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The aromatic sulfonamido group represented by $T^2$ is preferably a benzenesulfonamido group having from 6 to 8 carbon atoms which may be substituted, and examples of the substituents include a halogen atom (e.g., F, Cl, Br, I), a cyano group, an alkyl group having from 1 to 4 carbon atoms, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

The ureido group represented by $T^2$ is a ureido group which may be substituted, the substituents are preferably an alkyl group having from 1 to 8 carbon atoms or a phenyl group having from 6 to 8 carbon atoms, and examples of the substituents for these alkyl and phenyl groups include a halogen atom (e.g., F, Cl, Br, I), a cyano group, an alkyl group having from 1 to 4 carbon atoms, an alkoxy group having from 1 to 4 carbon atoms, an aryloxy group having from 6 to 8 carbon atoms, an alkenyl group having from 2 to 8 carbon atoms, an alkylthio group having from 1 to 8 carbon atoms, and an aryl group having from 6 to 8 carbon atoms.

Preferred as $G^2$ is a group wherein $=T^1$ represents $=O$ and $T_2$ represents an alkyl or alkoxy group having from 1 to 8 carbon atoms, or a phenyl group having from 6 to 8 carbon atoms which may be substituted.

$Z^2$ has the same meaning as $Z^1$.

$Z^4$ represents an atomic group necessary for forming a 5- or 6-membered nitrogen-containing heterocyclic ring together with (C—C=O), and examples of the 5- or 6-membered nitrogen-containing heterocyclic rings include a rhodanine nucleus, a 2-thiohydantoin nucleus, a 2-thioxooxazolidine-4-one nucleus, a 2-pyrazoline-5-one nucleus, a barbituric acid nucleus, a 2-thiobarbituric acid nucleus, a thiazolidine-2,4 -dione nucleus, a thiazolidine-4-one nucleus, an isooxazolone nucleus, a hydantoin nucleus, and an indanedione nucleus. Further, it may be an open chain type structure such as the ring derived from acetylacetone, malondinitrile, ethyl acetoacetate, and ethyl cyanoacetate is opened.

Atomic groups preferred as $Z^4$ are atomic groups necessary for forming acidic nuclei, and such acidic nuclei are disclosed in James, *Theory of the Photographic Process,* Macmillan (1977), p. 199, Table B. Atomic groups particularly preferred as $Z^4$ are those for forming a rhodanine nucleus and a thiohydantoin nucleus.

Examples of the substituents for a 5- or 6-membered heterocyclic ring formed by $Z^4$ include, in addition to the above described $G^1$ and $G^2$, an alkyl group, a substituted alkyl group, an aryl group, a substituted aryl group, and a heterocyclic group, for example, an alkyl group having from 1 to 18 carbon atoms (for example, methyl, ethyl, propyl, isopropyl, butyl, isobutyl, hexyl, octyl, dodecyl, octadecyl, preferably alkyl having from 1 to 7 carbon atoms, and particularly preferably an alkyl having from 1 to 4 carbon atoms), a substituted alkyl group (for example, aralkyl (e.g., benzyl, 2-phenylethyl), hydroxyalkyl (e.g., 2-hydroxyethyl, 3-hydroxypropyl), carboxyalkyl (e.g., 2-carboxyethyl, 3-carboxypropyl, 4-carboxybutyl, carboxymethyl), alkoxyalkyl (e.g., 2-methoxyethyl, 2-(2-methoxyethoxy)ethyl), sulfoalkyl (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), sulfatoalkyl (e.g., 3-sulfatopropyl, 4-sulfatobutyl), heterocyclic ring-substituted alkyl (e.g., 2-(pyrrolidine-2-on-1-yl)ethyl, tetrahydrofurfurino, 2-morpholinoethyl), 2-acetoxyethyl, carbomethoxymethyl, 2-methanesulfonylaminoethyl, allyl), an aryl group (for example, phenyl, 2-naphthyl), a substituted aryl group (for example, 4-carboxyphenyl, 4-sulfophenyl, 3-chlorophenyl, 3-methylphenyl), and a heterocyclic group (for example, 2-pyridyl, 2-thiazolyl).

$Z^5$ and $Z^6$ are atomic groups necessary for forming a 5- or 6-membered nitrogen-containing heterocyclic ring together with (C—C=O), and the 5- or 6-membered ring formed by $Z^5$ and $Z^6$ together with (C—C=O) is a ring removed an oxo group or a thioxo group at the appropriate position from the ring having the total of two carbonyl or thiocarbonyl groups among the 5- or 6-membered rings formed by $Z^4$. $Z^5$ and $Z^6$ each preferably represents —O—, —S—, —N($R^4$)—, wherein $R^4$ represents an alkyl group, an aryl group or a heterocyclic group, e.g., methyl, ethyl, phenyl, 2-pyridyl, 2-carboxyethyl, carboxymethyl, 2-hydroxyethyl, 2-sulfoethyl, and 2-acetamidoethyl. $Z^5$ more preferably represents —S— or —N($R^4$)— and $Z^6$ more preferably represents —O— or —N($R^4$)—, and a particularly preferred combination of $Z^5$ and $Z^6$ is a combination in which $Z^5$ represents —N($R^4$)— and $Z^6$ represents —O—, or $Z^5$ represents —S— and $Z^6$ represents —N($R^4$)—.

$Z^7$ represents an atomic group necessary for forming a benzene ring or a naphthalene ring. The carbon atoms on the ring may have substituents other than $G^1$ and $G^2$. Examples of the substituents on the ring for $Z^7$ are the same as those described for $Z^1$.

$R^2$ has the same meaning as $R^1$. It is preferred that at least either one of the aliphatic group or aromatic group represented by $R^1$ or $R^2$ have an acidic group or a group corresponding to the salt thereof.

$R^3$ has the same meaning as $R^1$.

$L^1$ represents a methine group which may be substituted, or a trivalent group obtained by making 3, 5 or 7 methine groups link by a conjugated double bond; $L^2$ represents a tetravalent group obtained by making 2, 4 or 6 methine groups link to form a conjugated double bond which may be substituted. Examples of the substituents for the methine groups constituting the groups represented by $L^1$ or $L^2$ include an alkyl group (preferably having from 1 to 7 carbon atoms, e.g., methyl, ethyl, cyclopropyl, benzyl), an aryl group (preferably having from 6 to 10 carbon atoms, e.g., phenyl, toluyl, chlorophenyl, pyrazolyl), and an amino group (preferably having from 1 to 12 carbon atoms, e.g., diphenylamino, methylphenylamino, 4-acetylpiperazin-1-yl). These groups on the methine groups may be linked to form a cyclopentene ring or a cyclohexene ring.

Examples of $L^1$ include, for example, =CH—, =CH—CH=CH—, =CH—CH=CH—CH=CH— and =CH—CH=CH—CH=CH—CH=CH—. Examples of $L^2$ include, for example, =CH—CH=, =CH—CH=CH—CH= and =CH—CH=CH—CH=CH—CH=.

$L^1$ preferably represents a methine group or a trivalent group obtained by making three methine groups link so as to form a conjugated double bond. When $L^1$ comprises three methine groups, preferably each methine group is unsubstituted, or only the central methine group of the three methine groups may be substituted, and substituents for the central methine group are preferably a lower alkyl group such as methyl or ethyl, methylthio, phenyl or benzyl, and particularly preferably ethyl.

$L^2$ preferably represents a tetravalent group obtained by making two methine groups link so as to form a conjugated double bond.

q represents 0 or 1 and preferably 0.

j represents 0 or 1 and preferably 1.

The counter ion represented by A is necessary number of cation or anion for maintaining the equilibrium of the charge of the compound, for example, cation such as sodium ion, potassium ion, tertiary ammonium ions, quaternary ammonium ions, pyridinium ions, phosphonium ions, and anion such as halide ion, carboxylate ions, sulfonate ions, phenolate ions, and imidate ions.

Of formulae (II), (III) and (IV), formula (II) is preferred.

Specific examples of the compounds represented by formula (I) of the present invention are shown below, but the present invention is not limited thereto.

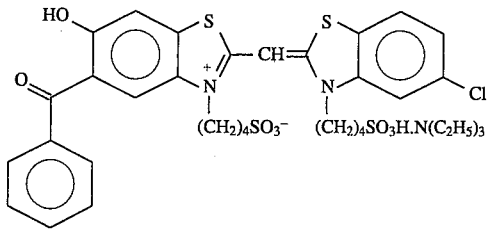
1-1
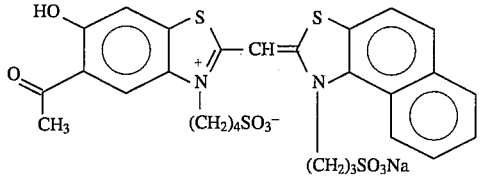
1-2
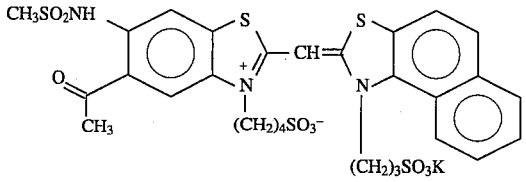
1-3
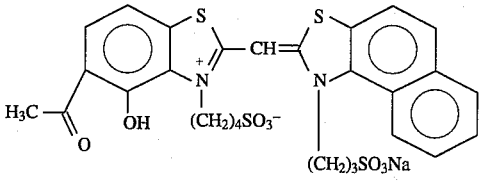
1-4
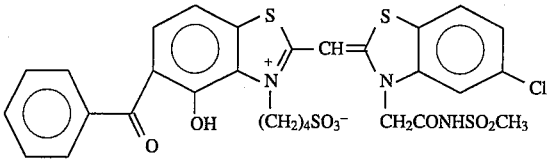
1-5
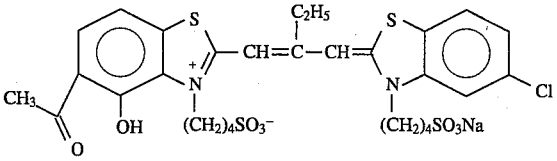
1-6
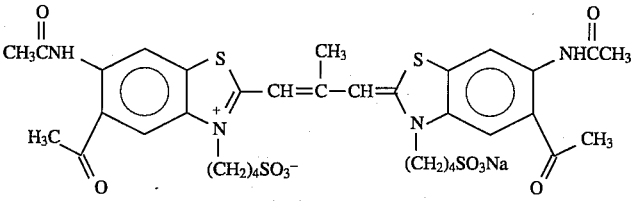
1-7
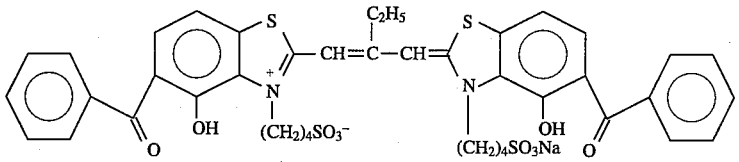
1-8

-continued
1-9
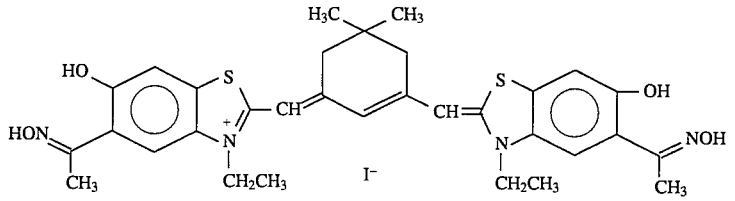
1-10
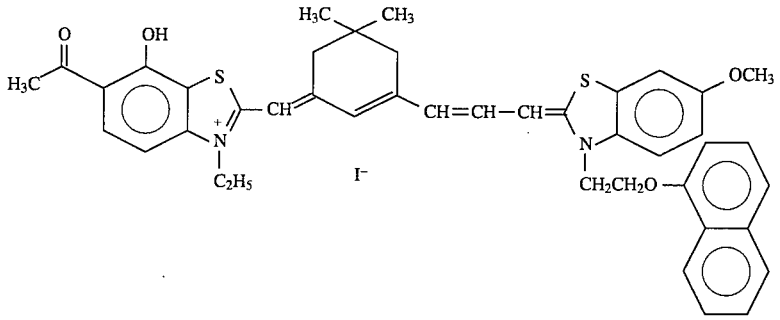
1-11
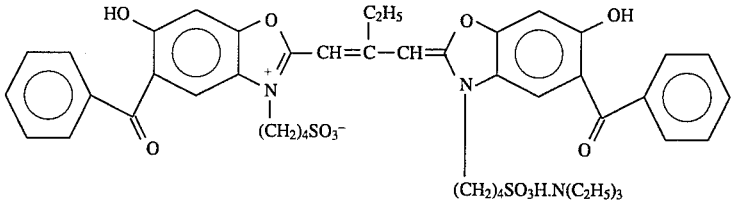
1-12
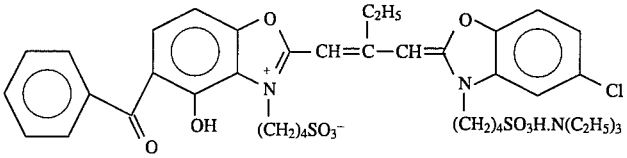
1-13
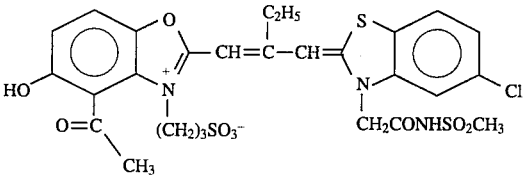
1-14
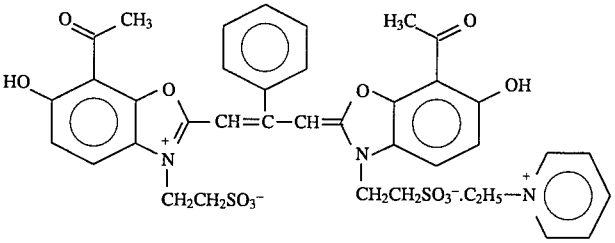
1-15
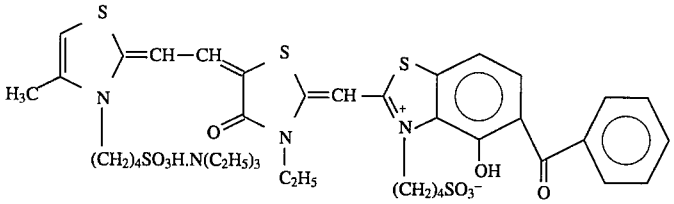

-continued
1-16
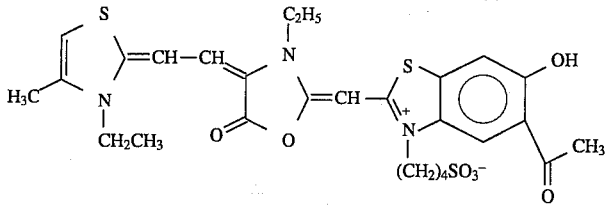
1-17
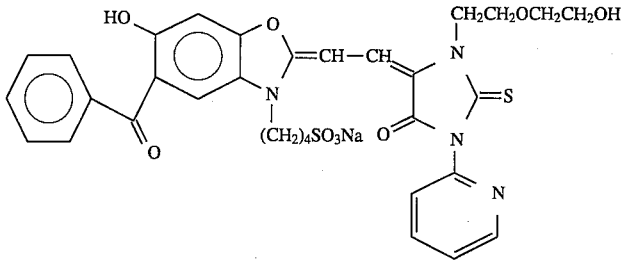
1-18
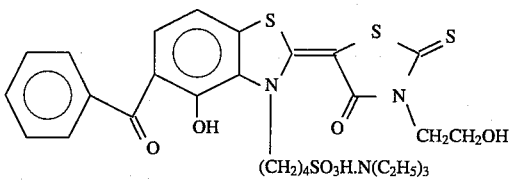
1-19
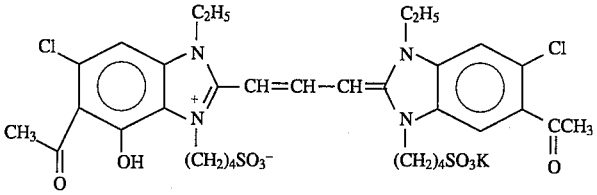
I-20
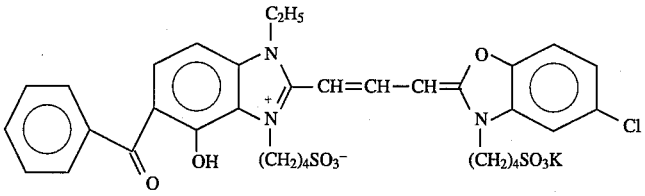
I-21
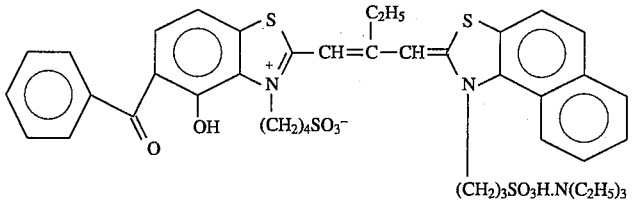
1-22
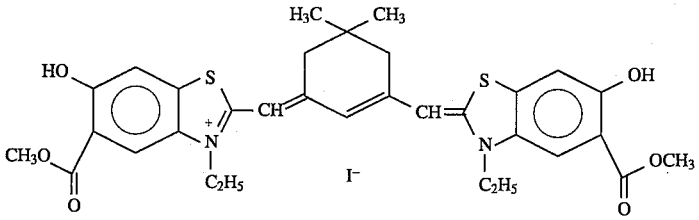
I-23
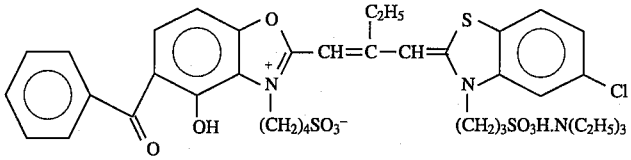

-continued
I-24
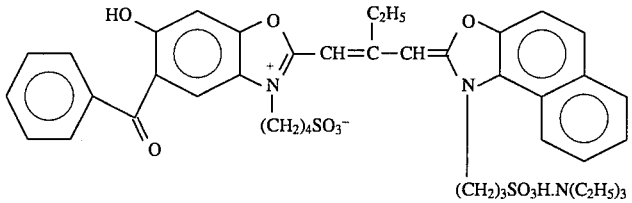
1-25
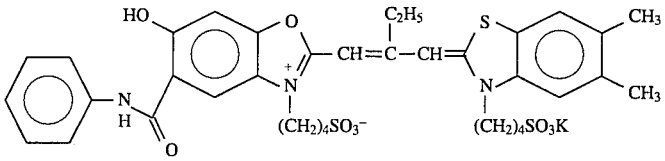
1-26
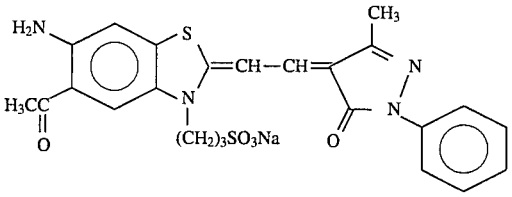
1-27
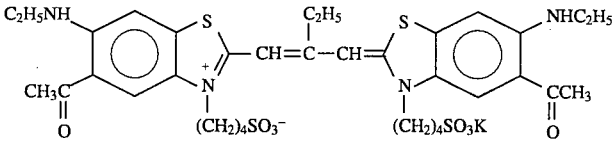
1-28
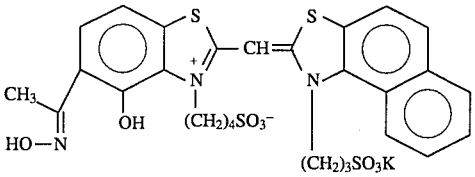
1-29
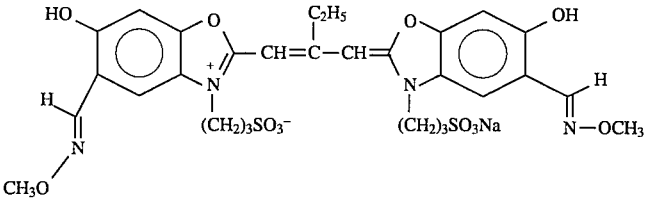
1-30
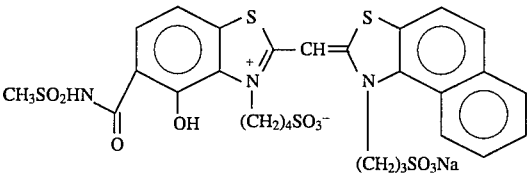
1-31
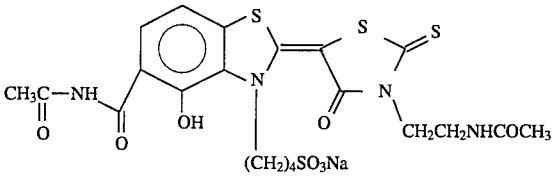
1-32
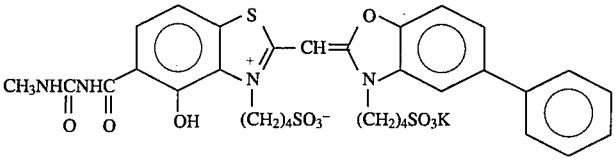

The compounds represented by formula (I) of the present invention can be easily synthesized by one skilled in the art referring to, for example, F. M. Harmer, *The Cyanine Dyes and Related Compounds,* Interscience Publishers, N.Y. (1964), pages 55 et seqq.; Nikolai Tyutyulkov, Jurgen Fabian, Achim Mehlhorn, Fritz Dietz, Alia Tadjet, *Polymethine dyes,* St. Kliment Ohridski University Press, Sophia (1992), pp. 23 to 38; and *Research Disclosure,* Vol. 152 (1976), p. 48.

The amount used of the methine compound in the present invention is from 0.01 to 4 mmol, preferably from 0.2 to 2.5 mmol, per mol of the silver halide, and is contained in the silver halide photographic emulsion. Further, the methine compound may be used in combination with other sensitizing dyes.

The silver halide for use in the present invention may be arbitrary known types of silver halides, for example, silver bromoiodide, silver bromide, silver chloride or silver chlorobromide.

The types of the silver halide grains for use in the present invention are not limitative, and substantially any types of the silver halide grains can be used in the present invention. As the dyes of the present invention cause less residual color stains, large quantities of the dyes can used, and the combined use with tabular grains which are liable to increase dye stains due to their large surface area is effective. Tabular grains have two substantially parallel crystal planes which are larger than other crystal planes of the grains. At least 50% of tabular grains in the emulsion preferably are the grain mother group occupied by tabular grains satisfying the equation AR/t>25. In the equation, AR means aspect ratio and equals D/t. D is the diameter of the grain expressed in a unit "μm". t is the thickness between two substantially parallel crystal planes of the grain expressed in the unit "μm". The diameter of the grain D is determined by calculating the diameter of the circle having the equal area with the surface area of one crystal plane of the two substantially parallel crystal planes. The grain size distribution of the silver halide grains may be any arbitrary size distribution known as useful as the photographic composition and may be polydisperse or monodisperse.

The silver halide grains for use in the present invention can be prepared according to known methods in the art, for example, the methods disclosed in *Research Disclosure,* Item 308119 (December, 1989) (hereinafter referred to as *Research Disclosure I*) and James, *The Theory of the Photographic Process,* 4th Ed., Macmillan (1977). *Research Disclosure* is published by Kenneth Mason Publications, Ltd., Dudley Annex, 21a North Street, Emsworth, Hamphi re P010 70Q, England. That is, an ammoniacal emulsion preparation method, a neutral or acid emulsion preparation method and other methods known in the art can be used. These methods generally include controlling the temperature, pAg and pH values in pertinent values during silver halide formation by mixing a water-soluble silver salt and a water-soluble halide in the presence of a protective colloid and precipitating.

It is effective for the silver halide for use in the present invention to be subjected to chemical sensitization with, for example, a gold sensitizer (e.g., gold sulfide) and other sensitizers known in the art. The useful compounds and methods of the chemical sensitization of silver halide are well known in the art and are disclosed in, for example, *Research Disclosure I* and in the references cited therein.

The silver halide may be sensitized with the methine dye of the present invention using optional methods known in the art, for example, the methods disclosed in *Research Disclosure I.* The dye may be added to a silver halide grain emulsion and a hydrophilic colloid prior to or simultaneously with the coating of the emulsion on photographic elements (for example, during or after chemical sensitization). The dye and silver halide emulsion can be mixed with the dispersion of the color image forming couplers just before coating or before coating (e.g., two hours before).

The sensitizing dye of the present invention can be preferably coated as a layer of the photographic element. Substantially, optional types of emulsions can be used (for example, a negative-working emulsion, e.g., an unfogged internal latent image forming surface sensitive emulsion, a direct positive emulsion, e.g., a surface fogged emulsion, and other emulsions, for example, those disclosed in *Research Disclosure I*).

The photographic emulsion generally include vehicles for coating the emulsion as a layer of the photographic element. Examples of useful vehicles include natural materials, e.g., protein, protein derivatives, cellulose derivatives (for example, cellulose esters), gelatin (for example, alkali-processed gelatin, e.g., cattle bone gelatin and animal skin gelatin, and acid-processed gelatin, e.g., pig skin gelatin), gelatin derivatives (for example, acetylated gelatin and phthalated gelatin), and those disclosed in *Research Disclosure I.* Hydrophilic water-permeable colloid is also useful as a vehicle or a vehicle extending agent. Examples thereof include a synthetic polymer deflocculant, a carrier, and/or a binder, for example, poly(vinyl alcohol), poly(vinyl lactam), an acrylamide polymer, polyvinyl acetal polymer, hydrolyzed polyvinyl acetate or alkyl acrylate, sulfoalkyl acrylate and sulfoalkyl methacrylate, polyamide, polyvinyl pyridine, a methacrylamide copolymer and those disclosed in *Research Disclosure I.* Vehicles can be present in the emulsion in an optional amount which is known to be useful for the photographic emulsion.

The emulsion can contain optional additives which are known to be useful for the photographic emulsion. Examples thereof include chemical sensitizers, e.g., active gelatin, sulfur, selenium, tellurium, gold, platinum, palladium, iridium, osmium, rhenium, and phosphorus, and combinations thereof. Chemical sensitization is, in general, carried out at pAg of from 5 to 10, pH of from 5 to 8, and temperature of from 30° to 80° C., as disclosed in *Research Disclosure,* Item 13452 (June, 1975) and U.S. Pat. No. 3,772,031.

Examples of other additives include an antifoggant, a stabilizer, a filter dye, a light absorbing or reflecting pigment, a hardening agent, e.g., a gelatin hardening agent, a coating aid, a dye forming coupler, a development modifier, e.g., a development inhibitor releasing coupler, a time controlling development inhibitor releasing coupler and a bleaching accelerator. These additives and methods of addition of these additives to the emulsion and other photographic layers are well known in the art and disclosed in *Research Disclosure I* and in the references cited therein.

The emulsion can also contain a brightening agent, e.g., a stilbene brightening agent. Such a brightening agent is well known in the art. Even if the brightening agent is not used, the dye represented by formula (I) suppresses dye stain to a minimum. The brightening agent is used in order to inhibit dye stain.

The emulsion layer which contains a silver halide sensitized with the dye represented by formula (I) of the present invention can be coated at the same time with or succeeding to the coating of other emulsion layer, a subbing layer, a filter dye layer, an interlayer, or an overcoat layer. These layers can contain various additives which are known to be included in the photographic elements. Such additives include an antifoggant, a scavenger for an oxidized developing agent, a DIR coupler, an antistatic agent, an optical brightening agent, and a light absorbing or light scattering pigment.

The layers of photographic element can be coated using known coating methods in the art, such as, for example, a dip coating method, a roller coating method, a reverse roll coating method, an air knife coating method, a doctor blade coating method, a stretch flow coating method and a curtain coating method. The coating layer of the photographic element may be set by chilling or may be dried, or both may be carried out. Drying may be accelerated by known methods such as conduction, convection and radiation heating, or combinations thereof.

The photographic emulsion of the present invention can be applied to various color and black-and-white photographic materials, such as color negative films for photographing (for general use, motion picture), color reversal films (for slide, motion picture, there are both cases containing and not containing couplers), color printing paper, color positive films (for motion picture), color reversal photographic paper, color photographic materials for heat development, color photographic materials using silver dye bleaching process, photographic materials for photomechanical process (lith films, scanner films), X-ray photographic materials (direct and indirect medical use, industrial use), black-and-white negative films for photographing, black-and-white photographic paper, photographic materials for microphotography (for COM, microfilms), color diffusion transfer photographic materials (DTR), silver salt diffusion transfer photographic materials, and print out photographic materials.

It is preferably used in a system in which X-ray is irradiated to the human body and the other subjects to be photographed and the X-ray penetrated through the subjects is converted to a visible light and light-sensitized, such as X-ray films for direct and indirect photographing and CRT films. Specifically, X-ray photographic materials for medical and industrial use, X-ray dupe photographic materials and photographic materials for medical CRT images can be enumerated.

The photographic elements comprising the composition of the present invention can be processed according to at least any of various known photographic processes using at least any of various known processing compositions disclosed in, for example, *Research Disclosure I* or James, *The Theory of the Photographic Process,* 4th Ed., Macmillan (1977).

The addition of the dyes capable of decoloration by processing (oxonol dyes and cyanine dyes, of all), disclosed in EP-A-337490, pages 27 to 76, to the hydrophilic colloid layers of the photographic material of the present invention is preferred for the purpose of prevention of irradiation and halation or improvement of the safelight safety. Particularly, the water-soluble dyes disclosed in JP-A-5-127324 (the term "JP-A" as used herein means a "published unexamined Japanese patent application") are preferably used as the dyes which hardly deteriorate color separation or the safelight safety even if the amount used is increased. The following coating amount can be made as a standard of the preferred coating amount of these water-soluble dyes.

Cyan dye: 20 to 100 mg/m$^2$

Magenta dye: 0 to 50 mg/m$^2$

Yellow dye: 0 to 30 mg/m$^2$

It is preferred in the present invention to coat a coloring layer containing a solid fine grain dye or colloidal silver as described above or/and to color a hydrophilic colloid layer by a water-soluble dye.

With respect to the optical reflection density of the unexposed photographic material of the present invention, the optical reflection density value at the wavelength of the highest optical reflection density in the visible light region of 400 nm to 700 nm is preferably from 0.2 to 2.0, more preferably from 0.2 to 1.5, and most preferably from 0.2 to 1.2. The kind and coating amount of a colorant (for example, a white pigment, a solid fine grain dye, an irradiation preventing dye, a colloidal silver) can be selected within the range satisfying the above conditions. In the region of the optical reflection density of 0.2 or less, the effect of sharpness by the colorant cannot substantially be expected, while in the region of the optical reflection density of 2.0 or more, the deterioration of the white portion due to the residual color is conspicuous and impracticable.

Moreover, the optical reflection density in the present invention is determined by the reflection densitometer generally used in the art and is defined as follows. However, a sample should be lined with a standard reflector to prevent measuring error due to light to penetrate through the sample.

Optical reflection density=$\log_{10}(F_0/F)$ $F_0$: Reflected beam of light of the standard white reflector F: Reflected beam of light of the sample The color photographic material of the present invention comprises a reflective support having coated thereon at least one yellow color forming silver halide emulsion layer, at least one magenta color forming silver halide emulsion layer, and at least one cyan color forming silver halide emulsion layer. In a color photographic paper for general use, color reproduction can be effected according to the subtractive color process by incorporating into silver halide emulsion layers color couplers capable of forming dyes having a complementary color relationship to light to which the corresponding silver halide emulsion is sensitized. In a typical color photographic paper, silver halide emulsion grains are spectrally sensitized in the above described order of the color forming layers by blue-sensitive, green-sensitive and red-sensitive spectral sensitizing dyes, and coated on a support in the above described order. However, the coating can be effected by different orders. That is, there are cases when the light-sensitive layer containing the silver halide grains having the largest average grain size is preferred to be uppermost layer from the viewpoint of rapid processing or when the magenta color forming light-sensitive layer is preferred to be undermost layer considering the storage stability under light irradiation.

Further, a constitution of a different correspondence of a light-sensitive layer to a hue of developed color from those described above may be employed, and at least one infrared-sensitive silver halide emulsion layer can be provided.

The silver halide grains for use in the above photographic material include silver chloride, silver bromide, silver (iodo)chlorobromide and silver iodobromide. Particularly in the present invention it is preferred to use substantially silver iodide-free silver chlorobromide grains or silver halide grains comprising silver chloride to speed up the development processing time. The terminology "substantially silver iodide-free" as used herein means that the iodide content therein is 1 mol % or less (inclusive of zero), preferably 0.2 mol % or less (inclusive of zero). On the other hand, there is a case where high silver chloride grains containing from 0.01 to 3 mol % of silver iodide on the surface of the emulsion are preferably used, as disclosed in JP-A-3-84545, for purposes of heightening high intensity sensitivity, spectral sensitization sensitivity, or the storage stability of photographic materials. The halide composition of the emulsion may be the same or different between grains, but uniform properties of grains can easily be achieved by using emulsions having the same halide composition between grains. The distribution of the halide composition inside the silver halide emulsion grains includes grains of a uniform type structure which have a uniform halide composition throughout the silver halide grains, grains of a layer type structure which are different in the halide composition in the interior of the grains (core) and the halide composition of the part surrounding the core (shell) (comprising one or a plurality of layers), or grains of a structure which contain parts of different halide compositions in the interior of the grains or at the surface in a non-layer structure (such a structure that the parts of different compositions are conjugated at edges, corners or faces of the grains when they are present at the surface of the grains), and these grains can be arbitrarily selected depending on the purposes. It is more advantageous to use the grains of either of the latter two than to use the grains of a uniform structure for the purpose of attaining high sensitivity, and is preferred from the point of pressure resistivity. When the silver halide grains have the above described non-uniform structure, the boundary between the parts of different halide compositions may be clear, or may be unclear forming mixed crystals depending on the difference in the halide composition. Further, the boundary may be made of a continuous change in structure positively.

A so-called high silver chloride emulsion having a high content of silver chloride is preferably used in a photographic material applicable to rapid processing as in the present invention. The silver chloride content of the high silver chloride emulsion is preferably 90 mol % or more, more preferably 95 mol % or more in the present invention.

It is preferred for such a high silver chloride emulsion to have a structure such that silver bromide rich localized phases are present inside and/or at the surface of the silver halide grains in the form of a layer or non-layer structure. The halide composition of the above described localized phases is preferably such that the silver bromide content is at least 10 mol %, and more preferably exceeding 20 mol %. The silver bromide content of the silver bromide rich localized phases can be analyzed according to X-ray diffraction method (for example, *Shin-Jikken Kagaku Koza* 6, *Kozo Kaiseki* (*New Experimental Chemistry Course* 6, *Analysis of Structure*), edited by Nihon Kagaku Kai, published by Maruzen) or the like. These localized phases can be present inside the grains, or at the edges, corners or faces of the grain surface. One preferred example of the localized phase is that formed by epitaxial growth at the corners of the grains.

Also, it is effective to increase the silver chloride content of a silver halide emulsion to reduce the amount replenished of the development processing solution. In such a case, substantially a pure silver chloride emulsion having a silver chloride content of from 90 mol % to 100 mol % is also preferably used.

The average grain size of the silver halide grains contained in the silver halide emulsion for use in the above described photographic material (the grain size herein refers to the diameter of the circle corresponding to the projected area of the grains, and the number average is taken as the average grain size) is preferably from 0.1 μm to 2 μm.

With respect to the distribution of sizes of these grains, a so-called monodisperse emulsion having a variation coefficient (the value obtained by dividing the standard deviation of the grain size distribution by the average grain size) of 20% or less, preferably 15% or less, and more preferably 10% or less, is preferred. The above monodisperse emulsions can preferably be used with mixing them in the same layer or separately in multilayer for obtaining a wide latitude.

The silver halide grains contained in the photographic emulsion may have a regular crystal form, such as cubic, tetradecahedral, or octahedral, an irregular crystal form, such as spherical, tabular or the like, or a composite form of these forms. A mixture of various crystal forms of grains may also be used. It is preferred in the present invention that the proportion of the grains having such a regular crystal form as described above to the entire grains be 50% or more, preferably 70% or more, and more preferably 90% or more.

Further, an emulsion in which the proportion of tabular grains having an average aspect ratio (diameter of circle equal to projected area/thickness) of 5 or more, preferably 8 or more, to the entire grains exceeds 50% as a projected area is also preferably used.

The silver chlorobromide emulsions which are used in the present invention can be prepared according to the methods disclosed, for example, in P. Glafkides, *Chimie et Physique Photographique,* Paul Montel (1967), G. F. Duffin, *Photographic Emulsion Chemistry,* Focal Press (1966), V. L. Zelikman, et al., *Making and Coating Photographic Emulsion,* Focal Press (1964), and so on. That is, any process, such as an acid process, a neutral process, and an ammoniacal process, can be used. A single jet method, a double jet method, and a combination of these methods are known as methods for reacting a soluble silver salt with a soluble halide, and any of these methods can be used. A method in which silver halide grains are formed in the atmosphere of excessive silver ion (a so-called reverse mixing method) can also be used. Further, a so-called controlled double jet method, which is one form of a double jet method, in which the pAg of the liquid phase in which the silver halide is formed is maintained constant can also be used. According to this method, a silver halide emulsion having a regular crystal form and substantially a uniform grain size distribution can be obtained.

It is preferred to include different kinds of metal ions or complex ions thereof in the localized phase and its substrate of the silver halide grains of the present invention. Preferred examples of such metals include ions or complexes of metals of group VIII and group IIb of the Periodic Table, and lead ion and thallium ion. Ions or complex ions thereof selected from iridium, rhodium, and iron can be mainly used in the localized phase, and metal ions or complex ions selected from osmium, iridium, rhodium, platinum, ruthenium, palladium, cobalt, nickel, and iron can be mainly used in the substrate, in combination. The kind and concentration of the metal ions can be varied in the localized phase and the substrate. These metals may be used plurally. In particular, iron and iridium compounds are preferred to be present in the silver bromide rich localized phase.

These metal ion donating compounds are included in the localized phase and/or other part of the grains (substrate) of the silver halide grains of the present invention at the time of the formation of silver halide grains, by means of addition to a dispersion medium such as an aqueous solution of gelatin, an aqueous solution of halide, an aqueous solution of silver salt or other aqueous solutions, or by addition in the form of silver halide grains which have previously contained the metal ion and dissolving these grains.

The inclusion of the metal ions for use in the present invention in emulsion grains can be carried out sometime before formation of grains, during formation of grains, or immediately after formation of grains. The time of the addition can be varied depending on the position of the grains where the metal ion is to be included.

The silver halide emulsions in the photographic material for use in the present invention are generally chemically and spectrally sensitized.

Chemical sensitization can be carried out by chemical sensitization utilizing a chalcogen sensitizer (specifically, sulfur sensitization represented by the addition of an unstable sulfur compound, selenium sensitization utilizing a selenium compound, and tellurium sensitization utilizing a tellurium compound), noble metal sensitization represented by gold sensitization, and reduction sensitization, alone or in combination thereof. Compounds which are preferably used for chemical sensitization include those disclosed in JP-A-62-215272, from page 18, right lower column to page 22, right upper column.

The emulsion to be used in the present invention is a so-called surface latent image type emulsion in which the latent image is mainly formed on the surface of the grain.

Various compounds or precursors thereof can be incorporated in the silver halide emulsion for use in the photographic material of the present invention to prevent fogging from occurring during preparation process, storage or photographic processing of the photographic material or stabilize photographic performances. Specific examples of compounds useful for the above purposes are disclosed in JP-A-62-215272, pages 39 to 72, and they can be preferably used. In addition, 5-arylamino-1,2,3,4-thiatriazole compounds (the aryl residue has at least one electron attractive group) disclosed in European Patent 447,647 are also preferably used.

As spectral sensitizing dyes which are used in the photographic material of the present invention for spectral sensitization of blue, green and red light regions, spectral sensitizing dyes other than the methine dyes of the present invention may be used in combination. Examples of the dyes which are used in combination include those disclosed in F. M. Harmer, *Heterocyclic Compounds—Cyanine Dyes and Related Compounds,* John Wiley & Sons, New York, London (1964). Specific examples of the compounds and spectral sensitization methods which are preferably used in the present invention include those disclosed in JP-A-62-215272, from page 22, right upper column to page 38, and particularly preferred above all are compounds not having a carboxyl group in the molecule, such as Compounds (S-1) to (S-19), (S-21), (S-23) to (S-38), (S-40) to (S-44), (S-46) to (S-48), (S-51), (S-53), (S-55) to (S-58), (S-60), (S-62), (S-63), (S-66), (S-68), (S-71) to (S-83), (S-85) to (S-90). In addition, the spectral sensitizing dyes disclosed in JP-A-3-123340 are very preferred as red-sensitive spectral sensitizing dyes for silver halide emulsion grains having a high silver chloride content from the point of stability, adsorption strength, and the temperature dependency of exposure, and so on.

For the purpose of effective spectral sensitization in infrared region, the sensitizing dyes disclosed in JP-A-3-15049, from page 12, left upper column to page 21, left column, JP-A-3-20730, from page 4, left lower column to page 15, left lower column, European Patent 420,011, from page 4, line 21 to page 6, line 54, European Patent 420,012, page 4, line 12 to page 10, line 33, European Patent 443,466, and U.S. Pat. No. 4,975,362, are preferably used in the photographic materials of the present invention.

For the inclusion of these spectral sensitizing dyes in a silver halide emulsion, they may be directly dispersed in the emulsion, or they may be dissolved in a single or mixed solvent of water, methanol, ethanol, propanol, methyl cellosolve, 2,2,3,3-tetrafluoropropanol, etc., and then added to the emulsion. Further, they may be added to an emulsion as an aqueous solution coexisting with acid or base as described in JP-B-44-23389, JP-B-44-27555 and JP-B-57-22089 (the term "JP-B" as used herein means an "examined Japanese patent publication"), as an aqueous solution or colloidal dispersion coexisting with a surfactant as disclosed in U.S. Pat. Nos. 3,822,135 and 4,006,025. Moreover, they may be dissolved in a solvent substantially immiscible with water such as phenoxyethanol, etc., then dispersed in water or a hydrophilic colloid, and added to the emulsion. Alternatively, they may be directly dispersed in a hydrophilic colloid and the dispersion is added to the emulsion as disclosed in JP-A-53-102733 and JP-A-58-105141. The time of the addition to the emulsion may be at any stage of the preparation of the emulsion known as useful hitherto, that is, before grain formation of silver halide emulsion, during grain formation, immediately after grain formation and before entering washing step, before chemical sensitization, during chemical sensitization, immediately after chemical sensitization until cooling and solidifying the emulsion, or at the time of preparation of a coating solution, and the time can be selected arbitrarily. In general, it is conducted during the period after the completion of chemical sensitization and before coating, however, a method in which spectral sensitizing dyes are added at the same time with the addition of chemical sensitizers and spectral sensitization is carried out simultaneously with chemical sensitization can be employable as disclosed in U.S. Pat. Nos. 3,628,969 and 4,225,666, further, as disclosed in JP-A-58-113928, spectral sensitization can be conducted prior to chemical sensitization, or spectral sensitizing dyes can be added and spectral sensitization can be started before completion of the precipitation formation of the silver halide grains. Still further, spectral sensitizing dyes can be divided and added separately, that is, a part of them is added prior to chemical sensitization and the remaining is added after chemical sensitization as disclosed in U.S. Pat. No. 4,225,666, therefore, any time during silver halide grain formation is feasible, as well as the methods disclosed in U.S. Pat. No. 4,183,756. The addition of the sensitizing dyes before washing step of the emulsion, or before chemical sensitization is particularly preferred, above all.

The amount of addition of these spectral sensitizing dyes can be varied over a wide range depending on purposes, but is preferably within the range of from $0.5\times10^{-6}$ mol to $1.0\times10^{-2}$ mol, and more preferably $1.0\times10^{-6}$ mol to $5.0\times10^{-3}$ mol, per mol of the silver halide.

When a spectral sensitizing dye having spectral sensitization sensitivity in the red region to the infrared region is used in the photographic material of the present invention, it is preferred to use the compounds disclosed in JP-A-2-157749, from page 13, right lower column to page 22, right lower column, in combination. The storage stability of a photographic material, the processing stability, and the effect of supersensitization can be extraordinarily heightened with the use of these compounds. The use of the compounds represented by formulae (IV), (V) and (VI) of the above patent in combination is particularly preferred. These compounds are used in the range of from $0.5\times10^{-5}$ mol to $5.0\times10^{-2}$ mol, preferably from $5.0\times10^{-5}$ mol to $5.0\times10^{-3}$ mol, per mol of silver halide, and the effective using amount exists within the range of from 0.1 to 10,000 times, preferably 0.5 to 5,000 times, per mol of sensitizing dye.

There are no particular limitations on various additives and development processing method for use in the photographic material of the present invention, for example, those described in the following places can be preferably used in addition to those described in Tables 1 to 5.

| Item | Places |
|---|---|
| 1) Hydrazine nucleating agent | line 19, right upper column, page 2 to line 3, right upper column, page 7 of JP-A-2-12236; and formula (II) and Compounds II-1 to II-54 in line 1, right lower column, page 20 to line 20, right upper column, page 27 of JP-A-3-174143 |
| 2) Nucleation accelerating agent | formulae (II-m) to (II-p) and Compounds II-1 to II-22 in line 13, right upper column, page 9 to line 10, left upper column, page 16 of JP-A-2-103536; and the compounds disclosed in JP-A-1-179939 |
| 3) Silver halide emulsion and the preparation method | line 12, right lower column, page 20 to line 14, left lower column, page 21 of JP-A-2-97937; line 19, right upper column, page 7 to line 12, left lower column, page 8 of JP-A-2-12236; and the selenium sensitization method in JP-A-5-11389 |
| 4) Spectral sensitizing dye | line 13, left lower column, page 8 to line 4, right lower column, page 8 of JP-A-2-12236; line 3, right lower column, page 16 to line 20, left lower column, page 17 of JP-A-2-103536; and the spectral sensitizing dyes in JP-A-1-112235, JP-A-2-124560, JP-A-3-7928, JP-A-5-11389 and JP-A-4-330434 |
| 5) Surfactant | line 7, right upper column, page 9 to line 7, right lower column, page 9 of JP-A-2-12236; and line 13, left lower column, page 2 to line 18, right lower column, page 4 of JP-A-2-18542; |
| 6) Antifoggant | line 19, right lower column, page 17 to line 4, right upper column, page 18 of JP-A-2-103536; lines 1 to 5, right lower column, page 18 of JP-A-2-103536; and the thiosulfinic acid compounds in JP-A-1-237538 |
| 7) Polymer latex | lines 12 to 20, left lower column, page 18 of JP-A-2-103536 |
| 8) Compound having acid radical | line 6, right lower column, page 18 to line 1, left upper column, page 19 of JP-A-2-103536 |
| 9) Matting agent, sliding agent and plasticizer | line 15, left upper column, page 19 to line 15, right upper column, page 19 of JP-A-2-103536 |
| 10) Hardening agent | lines 5 to 17, right upper column, page 18 of JP-A-2-103536 |
| 11) Dye | lines 1 to 18, right lower column, page 17 of JP-A-2-103536; and JP-A-2-294638 and the solid dyes in the same patent |
| 12) Binder | lines 1 to 20, right lower column, page 3 of JP-A-2-18542 |
| 13) Black pepper inhibitor | The compounds in U.S. Patent 4,956,257 and JP-A-1-118832 |
| 14) Redox compound | The compounds represented by formula (I) (particularly Compounds 1 to 50) in JP-A-2-301743; Formulae (R-1), (R-2) and (R-3), Compounds 1 to 75 on pages 3 to 20 in JP-A-3-174143; and the compounds in JP-A-5-257239 and JP-A-4-278939 |
| 15) Monomethine dye | The compounds represented by formula (II) (particularly Compounds II-1 to II-26) in in JP-A-2-287532 |
| 16) Dihydroxybenzenes | From left upper column, page 11 to left lower column, page 12 in JP-A-2-39948; and the compounds in EP-A-0452772 |
| 17) Developing solution and developing method | line 16, right upper column, page 19 to line 8, left upper column, page 21 in JP-A-2-103536 |

Gelatin can be preferably used as a binder or a protective colloid which can be used in the photographic material of the present invention, but hydrophilic colloid other than gelatin can be used alone or in combination with gelatin. Low calcium gelatin having a calcium content of preferably 800 ppm or less, more preferably 200 ppm or less, is preferably used as such gelatin. The inclusion of antibacterial agents disclosed in JP-A-63-271247 is preferred to prevent generation of various kinds of fungi and bacteria which proliferate in a hydrophilic colloid layer and deteriorate images.

Swelling, in the developing solution, of the hydrophilic colloid layer comprising the emulsion layer and the light-insensitive layer of the photographic material of the present invention coated on a support is preferably rapid for the purpose of achieving the object of the present invention. Specifically, the film thickness during color development is the value of the film thickness when a photographic material is immersed in an aqueous solution of alkali at 40° C., and the film thickness after 30 seconds preferably reaches 1.5 times or more of the dry film thickness. Preferably, the film thickness reaches 1.5 times or more of the dry film thickness after 20 seconds, more preferably 1.5 times or more after 10 seconds. Further, it is preferably 5 times or less. Such a magnification can be easily fixed by varying the kind and amount of the hardening agent used in a hydrophilic colloid layer. The dry film thickness used herein means the value of the film thickness measured, after the photographic material is stored at 25° C., 55% humidity for 2 hours or more, under the same conditions. An aqueous solution of alkali used herein is an aqueous solution of 0.2 mol/liter of sodium hydrogencarbonate (pH adjusted to 10.0 with sulfuric acid).

The photographic material of the present invention may be exposed with visible light or may be exposed with infrared light. An exposing method may be either low intensity exposure or high intensity exposure. A preferred exposing method of high intensity exposure is a laser scanning exposure system in which an exposure time per one picture element is $10^{-4}$ seconds or less, more preferably $10^{-6}$ seconds or less.

It is preferred to use a band stop filter as disclosed in U.S. Pat. No. 4,880,726 when the photographic material of the present invention is subjected to an exposure. Color mixing of light can be excluded and color reproducibility is remarkably improved by this means.

TABLE 1

| Photographic Constitutional Element | JP-A-62-215272 | JP-A-2-33144 | EP-A-355660 |
|---|---|---|---|
| Silver Halide Emulsion | p. 10, right upper column, l. 6 to p. 12, left lower column, l. 5, p. 12, right lower column, 4 line up from the bottom to p. 13, left upper column, l. 17 | p. 28, right upper column, l. 16 to p. 29, right lower column, l. 11 p. 30, ll. 2 to 5 | p. 45, l. 53 to p. 47, l. 3 p. 47. ll. 20 to 22 |
| Silver Halide Solvent | p. 12, left lower column, ll. 6 to 14 p. 13, left upper column, 3 line up from the bottom to p. 18, left lower column, last line | — | — |
| Chemical Sensitizer | p. 12, left lower column, 3 line up from the bottom to right lower column, 5 line up from the bottom p. 18, right lower column, l. 1 to p. 22, right upper column, 9 line up from the bottom | p. 29, right lower column, l. 12 to last line | p. 47. ll. 4 to 9 |
| Spectral Sensitizer (spectral sensitizing method) | p. 22, right upper column, 8 line up from the bottom to p. 38, last line | p. 30, left upper column, ll. 1 to 13 | p. 47. ll. 10 to 15 |
| Emulsion Stabilizer | p. 39, left upper column, l. 1 to p. 72, right upper column, last line | p. 30, left upper column, l. 14 to right upper column, l. 1 | p. 47, ll. 16 to 19 |
| Development Accelerator | p. 72, left lower column, l. 1 to p. 91, right upper column, l. 3 | — | — |

TABLE 2

| Photographic Constitutional Element | JP-A-62-215272 | JP-A-2-33144 | EP-A-355660 |
|---|---|---|---|
| Color Coupler (cyan, magenta, yellow) | p. 91, right upper column, l. 4 to p. 121, left upper column, l. 6 | p. 3, right upper column, l. 14 to p. 18, left upper column, last line p. 30, right upper column, l. 6 to p. 35, right lower column, l. 11 | p. 4, ll. 15 to 27 p. 5, l. 30 to p. 28, last line p. 45, ll. 29 to 31 p. 47, l. 23 to p. 63 l. 50 |
| Color Forming Intensifier | p. 121, left upper column, l. 7 to p. 125, right upper column, l. 1 | — | — |
| UV Absorbing Agent | p. 125, right upper column, l. 2 to p. 127, left lower column, last line | p. 37, right lower column, l. 14 to p. 38, left upper column, l. 11 | p. 65, pp. 22 to 31 |
| Discoloration Inhibitor (image stabilizing agent) | p. 127, right lower column, l. 1 to p. 137, left lower column, l. 8 | p. 36, right upper column, l. 12 to p. 37, left upper column, l. 19 | p. 4, l. 30 to p. 5, l. 23 p. 29, l. 1 to p. 45, l. 25 p. 45, ll. 33 to 40 p. 65, ll. 2 to 21 |
| High Boiling Point and/or Low Boiling Point Organic Solvent | p. 137, left lower column, l. 9 to p. 144, right upper column, last line | p. 35, right lower column, l. 14 to p. 36, left upper column, 4 line up from the bottom | p. 64, ll. 1 to 51 |
| Dispersing Method of Photographic Additives | p. 144, left lower column, l. 1 to p. 146, right upper column, l. 7 | p. 27, right lower column, l. 10 to p. 28, left upper column, last line p. 35, right lower column, l. 12 to p. 36, right upper column, l. 7 | p, 63, l. 51 to p. 64, l. 56 |

TABLE 3

| Photographic Constitutional Element | JP-A-62-215272 | JP-A-2-33144 | EP-A-355660 |
|---|---|---|---|
| Hardening Agent | p. 146, right upper column, l. 8 to p. 155, left lower column, l. 4 | — | — |
| Developing Agent Precursor | p. 155, left lower column, l. 5 to p. 155, right lower column, l. 2 | — | — |
| Development Inhibitor Releasing Compound | p. 155, right lower column, ll. 3 to 9 | — | — |
| Support | p. 155, right lower column, l. 19 to p. 156, left upper column, l. 14 | p. 38, right upper column, l. 18, to p. 39, left upper column, l. 3 | p. 66, l. 29 to p. 67, l. 13 |
| Layer Constitution of Photographic Material | p. 156, left upper column, l. 15 to p. 156, right lower column, l. 14 | p. 28, right upper column, ll. 1 to 15 | p. 45, ll. 41 to 52 |
| Dye | p. 156, right lower column, l. 15 to p. 184, right lower column, last line | p. 38, left upper column, l. 12 to right upper column, l. 7 | p. 66, ll. 18 to 22 |
| Color Mixture Preventive | p. 185, left upper column, l. 1 to p. 188, right lower column, l. 3 | p. 36, right upper column, ll. 8 to 11 | p. 64, l. 57 to p. 65, l.1 |
| Gradation Controlling Agent | p. 188, right lower column, ll. 4 to 8 | — | — |
| Stain Inhibitor | p. 188, right lower column, l. 9 to p. 193, right lower column, l. 10 | p. 37, left upper column, last line to right lower column, l. 13 | p. 65, l. 32 to p. 66, l. 17 |

TABLE 4

| Photographic Constitutional Element | JP-A-62-215272 | JP-A-2-33144 | EP-A-355660 |
|---|---|---|---|
| Surfactant | p. 201, left lower column, l. 1 to p. 210, right upper column, last line | p. 18. right upper column, l. 1 to p. 24, right lower column, last line<br>p. 27, left lower column, 10 line up from the bottom to right lower column, l. 9 | — |
| Fluorine-Containing Compound (as anti-static agent, coating aid, lubricant, adhesion preventive agent) | p. 210, left lower column, l. 1 to p. 222, left lower column, l. 5 | p. 25, left upper column, l. 1 to p. 27, right lower column, l. 9 | — |
| Binder (hydrophilic colloid) | p. 222, left lower column, l. 6 to p. 225, left upper column, last line | p. 38, right upper column, ll. 8 to 18 | p. 66, ll. 23 to 28 |
| Tackifier | p. 225, right upper column, l. 1 to p. 227, right upper column, l. 2 | — | — |
| Antistatic Agent | p. 227, right upper column, l. 3 to p. 230, left upper column, l. 1 | — | — |
| Polymer Latex | p. 230, left upper column, l. 2 to p. 239, last line | — | — |
| Matting Agent | p. 240, left upper column, l. 1 to p. 240, right upper column, last line | — | — |

TABLE 5

| Photographic Constitutional Element | JP-A-62-215272 | JP-A-2-33144 | EP-A-355660 |
|---|---|---|---|
| Photographic Processing Method | p. 3, right upper column, l. 7 to p. 10, right upper | p. 39, left upper column, l. 4 to p. 42, left upper | p. 67, l. 14 to p. 69, l. 28 |

TABLE 5-continued

| Photographic Constitutional Element | JP-A-62-215272 | JP-A-2-33144 | EP-A-355660 |
|---|---|---|---|
| (processing step and additives) | column, l. 5 | column, last line | |

Note)
References in column JP-A-62-215272 include contents amended by The Amendment dated March 16, 1987, which appears at the end of the Patent Publication.
Of couplers described above, so-called short wave type yellow couplers disclosed in JP-A-63-231451, JP-A-63-123047, JP-A-63-241547, JP-A-1-173499, JP-A-1-213648 and JP-A-1-250944 are preferably used as yellow couplers.

It is preferred that cyan, magenta or yellow couplers are impregnated with a loadable latex polymer (e.g., disclosed in U.S. Pat. No. 4,203,716) in the presence (or absence) of the high boiling point organic solvents disclosed in the above table, and dissolved in an organic solvent-soluble polymer and dispersed in a hydrophilic colloidal aqueous solution in an emulsified state.

Examples of polymers insoluble in water but soluble in an organic solvent which can preferably be used in the present invention include homopolymers or copolymers disclosed in U.S. Pat. No. 4,857,449, from columns 7 to 15, and WO 88/00723, from pages 12 to 30. Methacrylate based or acrylamide based polymers are preferred, in particular, acrylamide based polymers are preferred as to color image stability.

It is preferred to use color image preservability improving compounds disclosed in EP-A-277589 in combination with the couplers in the photographic material of the present invention. In particular, the use in combination with pyrazoloazole couplers and pyrrolotriazole couplers is preferred.

That is, the use of the compound (F) disclosed in the above EP Patent which produces a chemically inactive and substantially colorless compound upon chemically coupling with the aromatic amine based developing agent remaining after color development processing and/or the compound (G) disclosed in the above EP Patent which produces a chemically inactive and substantially colorless compound upon chemically coupling with the oxidation product of the aromatic amine based color developing agent remaining after color development processing, alone or in combination, is preferred for preventing the generation of stain due to the formation of a color dye caused by the coupling reaction of the coupler with the color developing agent or the oxidation product thereof remaining in the film, or preventing other side reactions, during preservation after processing.

In addition to the diphenylimidazole based cyan couplers disclosed in JP-A-2-33144, the use of 3-hydroxypyridine based cyan couplers disclosed in EP-A-333185 (above all, Coupler (42), 4-equivalent coupler is rendered 2-equivalent by substituted with a chlorine releasing group, and Couplers (6) and (9), cited as specific examples, are particularly preferred), the cyclic active methylene based cyan couplers disclosed in JP-A-64-32260 (above all, Couplers 3, 8 and 34 cited as specific examples are particularly preferred), the pyrrolopyrazole type cyan couplers disclosed in EP-A-456226, the pyrroloimidazole type cyan couplers disclosed in European Patent 484,909, pyrrolotriazole type cyan couplers disclosed in European Patent 488,248 and EP-A-491197 is preferred as cyan couplers. The use of pyrrolotriazole type cyan couplers is particularly preferred above all.

As yellow couplers, the acylacetamide type yellow couplers having a 3 to 5-membered cyclic structure at the acyl group as disclosed in EP-A-447969, the malondianilide type yellow couplers having a cyclic structure as disclosed in EP-A-482552, and the acylacetamide type yellow couplers having a dioxane structure as disclosed in U.S. Pat. No. 5,118,599 are preferably used, in addition to the compounds disclosed in the above table. Above all, the use of the acylacetamide type yellow couplers the acyl group of which is a 1-alkylcyclopropane-1-carbonyl group and the malondianilide type yellow couplers one of the anilides of which constitutes an indoline ring is particularly preferred. These couplers can be used alone or in combination.

The 5-pyrazolone based magenta couplers or pyrazoloazole based magenta couplers are used as magenta couplers as disclosed in the known literature in the above table. Above all, the pyrazolotriazole couplers to which a secondary or tertiary alkyl group is directly bonded at the 2-, 3- or 6-position of the pyrazolotriazole ring disclosed in JP-A-61-65245, the pyrazoloazole couplers which contain a sulfonamido group in the molecule disclosed in JP-A-61-65246, the pyrazoloazole couplers which have an alkoxyphenylsulfonamido ballast group disclosed in JP-A-61-147254, and the pyrazoloazole couplers which have an alkoxy group or an aryloxy group at the 6-position disclosed in EP-A-226849 and European Patent 294,785, are preferably used from the point of hue, image stability and coloring ability.

The processing materials and the processing methods disclosed in JP-A-2-207250, page 26, right lower column, line 1 to page 34, right upper column, line 9 and JP-A-4-97355, page 5, left upper column, line 17 to page 18, right lower column, line 20 are preferably used as the processing method of the present invention, in addition to the methods disclosed in the above table.

The processing materials and the processing methods which are used in image forming process of the photographic material of the present invention are described in detail below. At first, the case when the photographic material of the present invention is subjected to color development, desilvering, and water washing or stabilization process is described. The color developing solution for use in the present invention contains known aromatic primary amine developing agents. The preferred example thereof is a p-phenylenediamine derivative and representative examples include N,N-diethyl-p-phenylenediamine, 4-amino-N,N-diethyl-3-methylaniline, 4-amino-N-(β-hydroxyethyl)-N-methylaniline, 4-amino-N-ethyl-N-(β-hydroxyethyl)aniline, 4-amino-N-ethyl-N-(β-hydroxyethyl)-3-methylaniline, 4-amino-N-ethyl-N-(3-hydroxypropyl)-3-methylaniline, 4-amino-N-ethyl-N-(4-hydroxybutyl)-3-methylaniline, 4-amino-N-ethyl-N-(β-methanesulfonamidoethyl)-3-methylaniline, 4-amino-N,N-diethyl-3-(β-hydroxyethyl)aniline, 4-amino-N-ethyl-N-(β-methoxyethyl)-3-methylaniline, 4-amino-N-(β-ethoxyethyl)-N-ethyl-3-methylaniline, 4-amino-N-(3-carbamoylpropyl)-N-n-propyl-3-methylaniline, 4-amino-N-(3-carbamoylbutyl)-N-n-propyl-3-methylaniline, N-(4-amino-3-methylphenyl)-3-hydroxypyrrolidine, N-(4-amino-3-methylphenyl)-3-(hydroxymethyl)pyrrolidine, and N-(4-amino-3-methylphenyl)-3-pyrrolidinecarboxamide.

Further, these p-phenylenediamine derivatives may take the form of a salt such as sulfate, sulfite, hydrochloride, naphthalenedisulfonate and p-toluenesulfonate. The amount used of the aromatic primary amine developing agent is preferably from 0.002 mol to 0.2 mol, more preferably from 0.005 to 0.1 mol, per liter of the developing solution.

The generally applicable developing time of the color development processing is from 10 seconds to 3 minutes, but shorter time is preferred in the present invention for achieving rapid processing. Further, the processing temperature at that time is from 20° to 50° C., preferably from 30° to 45° C., and most preferably from 37° to 42° C. The replenishment rate is preferably reduced, and generally from 20 to 600 ml, preferably from 30 to 200 ml, per $m^2$ of the photographic material.

The processing time (for example, development processing time) used in the present invention means the time from the entry of the photographic material in the objective processing solution until the entry in the next processing solution.

Moreover, "from the beginning of the development process to the end of the drying process" means the time from the time when the photographic material enters the developing bath of the development processor until the material comes out from the drying apparatus through the drying process.

The use of substantially benzyl alcohol free processing solution is preferred for the execution of the present invention. Here, "substantially benzyl alcohol free" means that the benzyl alcohol concentration is preferably 2 ml/liter or less, more preferably 0.5 ml/liter or less, and most preferably the processing solution does not contain benzyl alcohol at all.

It is preferred for the color developing solution for use in the present invention substantially not to contain sulfite ion ("substantially not contain" means the concentration of sulfite ion is $3.0\times10^{-3}$ mol/liter or less) for preventing the fluctuation of photographic characteristics due to continuous processing and attaining the object of the present invention. Preferably, the concentration of the sulfite ion is $1.0\times10^{-3}$ mol/liter or less, most preferably the color developing solution does not contain sulfite ion at all, provided that a trace amount of sulfite ion which is used for preventing oxidation of the processing chemical kit in which the concentrated developing agent before preparation of a solution for use is contained is excluded.

It is further preferred for the color developing solution for use in the present invention substantially not to contain hydroxylamine ("substantially not contain" means the concentration of hydroxylamine is $5.0\times10^{-}$mol/liter or less) for preventing the fluctuation of photographic characteristics due to the fluctuation of the hydroxylamine concentration. Most preferably, the color developing solution does not contain hydroxylamine at all.

Organic preservatives are more preferably used in the color developing solution for use in the present invention in place of hydroxylamine and sulfite ion.

Organic preservatives herein means general organic compounds which reduce the deterioration speed of the aromatic primary amine color developing agent when added to a processing solution for a color photographic material. That is, organic preservatives herein means organic compounds which have functions to prevent the aerial oxidation of color developing agents and, above all, hydroxylamine derivatives (exclusive of hydroxylamine), hydroxamic acids, hydrazines, hydrazides, α-amino acids, phenols, α-hydroxyketones, α-aminoketones, sugars, monoamines, diamines, polyamines, quaternary ammonium salts, nitroxy radicals, alcohols, oximes, diamide compounds, and condensed ring amines are particularly effective organic preservatives. These organic preservatives are disclosed in JP-B-48-30496, JP-A-52-143020, JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-1-97953, JP-A-1-186939, JP-A-1-186940, JP-A-1-187557, JP-A-2-306244, and EP-A-530921. The various metals disclosed in JP-A-57-44148 and JP-A-57-53749, the salicylic acids disclosed in JP-A-59-180588, the amines disclosed in JP-A-63-239447, JP-A-63-128340, JP-A-1-186939 and JP-A-1-187557, the alkanolamines disclosed in JP-A-54-3532, the polyethyleneimines disclosed in JP-A-56-94349, and the aromatic polyhydroxy compounds disclosed in U.S. Pat. No. 3,746,544 may be used as preservatives, if necessary. The addition of alkanolamines such as triethanolamine, dialkylhydroxylamines such as N,N-diethylhydroxylamine and N,N-di(sulfoethyl-)hydroxylamine, α-amino acid derivatives such as glycine, alanine, leucine, serine, threonine, valine, and isoleucine, or aromatic polyhydroxy compounds such as sodium catechol-3,5-disulfonate is particularly preferred.

Particularly, a combined use of dialkylhydroxylamine with alkanolamines, or the dialkylhydroxylamine disclosed in EP-A-530921 with α-amino acids represented by glycine and alkanolamines is effective for improving the stability of a color developing solution, that is, for improving the stability during continuous processing.

The addition amount of these organic preservatives should be sufficient to prevent the deterioration of a color developing agent, and is preferably from 0.01 to 1.0 mol/liter, more preferably from 0.03 to 0.30 mol/liter.

It is preferred in the present invention to include a chlorine ion in a color developing solution in an amount of from $3.0\times10^{-2}$ to $1.5\times10^{-1}$ mol/liter, particularly preferably from $3.5\times10^{-2}$ to $1.0\times10^{-1}$ mol/liter. If the chlorine ion concentration is greater than $1.5\times10^{-1}$ mol/liter, the development is delayed, therefore, it is not preferred from the object of the present invention for attaining rapid processing and providing high maximum density. On the other hand, if the concentration is less than $3.0\times10^{-2}$ mol/liter, it is not preferred for inhibiting fog.

It is preferred in the present invention to include a bromine ion in a color developing solution in an amount of from $0.5\times10^{-5}$ to $1.0\times10^{-3}$ mol/liter, more preferably from $3.0\times10^{-5}$ to $5\times10^{-4}$ mol/liter. If the bromine ion concentration is greater than $1\times10^{-3}$ mol/liter, the development is delayed and the maximum density and the sensitivity are reduced, on the other hand, if it is less than $0.5\times10^{-5}$ mol/liter, fog cannot sufficiently be prevented.

A chlorine ion and a bromine ion may be directly added to a color developing solution, alternatively they may be eluted out from the photographic material to a color developing solution during development processing.

When they are directly added to a color developing solution, examples of materials which supply a chlorine ion include sodium chloride, potassium chloride, ammonium chloride, lithium chloride, magnesium chloride, and calcium chloride. Also, a chlorine ion may be supplied from the brightening agent included in a color developing solution. Examples of bromine ion supplying materials include sodium bromide, potassium bromide, ammonium bromide, lithium bromide, calcium bromide, and magnesium bromide.

When they are eluted from the photographic material during development processing, a chlorine ion and a bromine ion may be supplied from the emulsion or may be supplied from other than the emulsion.

The color developing solution for use in the present invention has pH of preferably from 9 to 13, and more preferably from 9 to 12.5. Other known developing solution component compounds can be included in the color developing solution.

The use of various buffers is preferred for maintaining the above pH level. Examples of buffers which can be used include carbonates, phosphates, borates, tetraborates, hydroxybenzoates, glycyl salts, N,N-dimethyl-glycine salts, leucine salts,-norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, and lysine salts. Carbonates, phosphates, tetraborates and hydroxybenzoates are excellent in solubility and buffering ability in a high pH range of pH 9.0 or more, and do not adversely affect photographic characteristics (such as to cause fogging) when added to a color developing solution and inexpensive, therefore, the use of these buffers is particularly preferred.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The buffers are added to a color developing solution in an amount of preferably 0.1 mol/liter or more, and particularly preferably from 0.1 mol/liter to 0.4 mol/liter.

Various chelating agents can be used in a color developing solution of the present invention for the purpose of preventing the precipitation of calcium and magnesium or improving the stability of the color developing solution. Examples of such chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, trans-cyclohexanediaminetetraacetic acid, 1,2-diaminopropanetetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and hydroxyethyliminodiacetic acid. These chelating agents may be used in combination of two or more of them, if necessary.

The addition amount of these chelating agent should be sufficient to mask the metal ions present in the color developing solution, and the amount is, for example, about 0.1 g to 10 g per liter.

A color developing solution can contain a development accelerator, if necessary.

For example, the thioether based compounds disclosed in JP-B-37-16088, JP-B-37-5987, JP-B-38-7826, JP-B-44-12380, JP-B-45-9019 and U.S. Pat. No. 3,813,247, the p-phenylenediamine based compounds disclosed in JP-A-52-49829 and JP-A-50-15554, the quaternary ammonium salts disclosed in JP-A-50-137726, JP-B-44-30074, JP-A-56-156826 and JP-A-52-43429, the amine based compounds disclosed in U.S. Pat. Nos. 2,494,903, 3,128,182, 4,230,796, 3,253,919, JP-B-41-11431, U.S. Pat. Nos. 2,482,546, 2,596,926, and 3,582,346, and the polyalkylene oxides disclosed in JP-B-37-16088, JP-B-42-25201, U.S. Pat. No. 3,128,183, JP-B-41-11431, JP-B-42-23883 and U.S. Pat. No. 3,532,501, and also 1-phenyl-3-pyrazolidones and imidazoles can be added as a development accelerator, if necessary.

An antifoggant can be included arbitrarily in the present invention, if desired. Alkali metal halides such as sodium chloride, potassium bromide and potassium iodide, and organic antifoggants can be used as an antifoggant. Specific examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

A desilvering process is carried out after color development. A desilvering process may be carried out separately as a bleaching process and a fixing process, or may be carried out at the same time (a bleach-fixing process). A desilvering process in the present invention is preferably carried out as a bleach-fixing process for simplifying the process and the reduction of the processing time. In addition, a bleach-fixing process can be carried out after a bleaching process to speed up the processing. Moreover, the processing can be carried out in two connected bleach-fixing baths, a fixing process can be carried out before a bleach-fixing process, or a bleaching process can be carried out after a bleach-fixing process.

Iron salt; compounds of multivalent metals such as iron(III), cobalt(III), chromium(IV) and copper(II); peracids; quinones; and nitro compounds can be used as a bleaching agent for a bleaching solution and a bleach-fixing solution. Representative bleaching agents include iron chloride; ferricyanide; bichromate; organic complex salts of iron(III) (for example, metal complex salt with aminopolycarboxylic acids, e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid); persulfate; bromate; permanganate; and nitrobenzene. The use of aminopolycarboxylic acid iron(III) complex salts such as ethylenediaminetetraacetic acid iron(III) complex salts and and 1,3-diaminopropanetetraacetic acid iron(III) complex salts is particularly preferred of them from the point of providing rapid processing and preventing environmental pollution. Further, aminopolycarboxylic acid iron(III) complex salts are particularly useful in both of a bleaching solution and a bleach-fixing solution.

Known additives can be added to a bleaching solution or a bleach-fixing solution, such as a rehalogenating agent such as ammonium bromide and ammonium chloride; a pH buffer such as ammonium nitrate; and a metal corrosion inhibitor such as ammonium sulfate.

It is preferred to include organic acids in a bleaching solution and a bleach-fixing solution, in addition to the above compounds, for inhibiting bleaching stain. Particularly preferred organic acids are compounds having an acid dissociation constant (pKa) of from 2 to 5.5, and specifically, acetic acid and propionic acid are preferred.

Thiosulfate, thiocyanate, thioether based compounds, thioureas, and large amounts of iodide can be used as a fixing agent for a fixing solution and a bleach-fixing solution, however, thiosulfate is generally used, and particularly ammonium thiosulfate can be most widely used. Further, the combined use of thiosulfate with thiocyanate, thioether based compounds, and thiourea is also preferred.

Sulfite, bisulfite, carbonyl bisulfite addition products or the sulfinic acid compounds disclosed in EP-A-294769 are preferred as preservatives for a fixing solution and a bleach-fixing solution. Moreover, the addition of various aminopolycarboxylic acids and organic phosphonic acids (e.g., 1-hydroxyethylidene-1,1-diphosphonic acid, N,N,N',N'-ethylenediaminetetraphosphonic acid) to a fixing solution and a bleach-fixing solution is preferred for stabilizing these solutions.

Further, it is possible to contain various kinds of brightening agents, defoaming agents, surfactants, polyvinyl pyrrolidone and methanol in a fixing solution and a bleach-fixing solution.

A bleaching solution, a bleach-fixing solution or prebaths thereof can include various kinds of bleaching accelerators, if necessary. Specific examples of such bleaching accelerators which can be used in the present invention include the compounds having a mercapto group or a disulfide bond disclosed in U.S. Pat. No. 3,893,858, West German Patent 1,290,812, JP-A-53-95630, *Research Disclosure,* No. 17129 (July, 1978); the thiazolidine derivatives disclosed in JP-A-50-140129; the thiourea derivatives disclosed in U.S. Pat. No. 3,706,561; the iodides disclosed in JP-A-58-16235; the polyethylene oxide compounds disclosed in West German Patent 2,748,430; the polyamine compounds disclosed in JP-B-45-8836; and a bromide ion. Above all, compounds having a mercapto group or a disulfide group are preferred for excellent accelerating effects, particularly those disclosed in U.S. Pat. No. 3,893,858, West German Patent 1,290,812 and JP-A-53-95630 are preferred. In addition, the compounds disclosed in U.S. Pat. No. 4,552,834 are also preferably used. These bleaching accelerators may be contained in photographic materials.

The total processing time of the bleaching and fixing processes is preferably shorter in the range not causing a desilvering failure for the purpose of shortening the processing time. The processing time is preferably from 5 seconds to 1 minute and more preferably from 5 seconds to 25 seconds. Further, the processing temperature is from 25° C. to 50° C. preferably from 35° C. to 45° C. The desilvering rate is increased and the occurrence of staining after processing is effectively prevented in the preferred temperature range.

Further, any known method of stirring can be used in each process of the present invention, however, stirring as vigorous as possible is preferred. Specific examples of the methods of forced stirring include the method in which a jet of the processing solution is impinged on the surface of the emulsion of the photographic material as disclosed in JP-A-62-183460 and JP-A-62-183461, the method in which the stirring effect is raised using a rotating means as disclosed in JP-A-62-183461, the method in which the photographic material is moved with bringing a wiper blade into contact with the surface of the emulsion thereof, which blade is installed in the solution, and the generated turbulent flow at the surface of the emulsion increases the stirring effect, and the method in which the circulating flow rate of the entire processing solution is increased. These means for increasing the stirring level are effective for the developing solution, the bleaching solution, the bleach-fixing solution, the fixing solution, the washing water and/or the stabilizing solution.

In addition, for example, the method disclosed in JP-A-62-183460, page 3, right lower column to page 4, right lower column, the example, can be used in the above each processing solution for use in the present invention, which comprises ejecting the processing solution fed by a pump from the slit or the nozzle installed opposite to the surface of the emulsion.

The performance of the processing of the present invention is relatively superior to combinations of processing other than that of the present invention at any condition of the open ratio of the processing solution [contact area of the processing solution with air ($cm^2$)÷volume of the processing solution ($cm^3$)], but the open ratio of the processing solution of from 0 to 0.1 $cm^{-1}$ is preferred considering the stability of the component of the processing solution. The range of from 0.001 $cm^{-1}$ to 0.05 $cm^{-1}$ is preferred practically in the continuous processing, and more preferably from 0.002 to 0.03 $cm^{-1}$.

The color photographic material of the present invention is generally subjected to water washing process after desilvering process. The stabilizing process can be carried out instead of the washing process. Any of known methods, for example, those disclosed in JP-A-57-8543, JP-A58-14834 and JP-A-60-220345 can be used in such a stabilizing process. Also, the combination of the washing process—the stabilizing process may be carried out with a stabilizing bath containing a dye stabilizer and a surfactant as a final both.

The washing water and the stabilizing solution can contain a water softener such as inorganic phosphoric acid, polyaminocarboxylic acid, and organic aminophosphonic acid; a metal salt such as Mg salt, Al salt, and Bi salt; a surfactant; and a hardenening agent.

The amount of the washing water in the washing process can be selected from the wide range according to the characteristics of the photographic materials (according to the materials which are used, for example, couplers, etc.), the application of the photographic materials, the temperature of the washing water, the number of the washing tanks (the number of the washing stages), the replenishing system, that is, whether a countercurrent system or a normal current, and other various conditions. When the amount of the washing water is greatly reduced, problems arise such that bacteria proliferate and suspended matters produced adhere to the photographic material. The method of reducing the calcium ion and magnesium ion concentrations as disclosed in JP-A-62-288838 can be used as a very effective means for overcoming these problems. Also, the isothiazolone compounds and the thiabendazoles as disclosed in JP-A-57-8542, the chlorine based antibacterial agents such as chlorinated sodium isocyanurate, the benzotriazole, and the antibacterial agents disclosed in Hiroshi Horiguchi, *Bohkin Bohbaizai no Kagaku* (*Chemistry of Antibacterial and Antifungal Agents,* published by Sankyo Shuppan K.K. (1986), *Biseibutsu no Mekkin, Sakkin, Bohbai Gijutsu* (*Germicidal and Antifungal Techniques of Microorganisms*), edited by Eisei Gijutsukai, published by Kogyo Gijutsukai (1982), and *Bohkin Bohbai Zai Jiten* (*Antibacterial and Antifungal Agents Thesaurus*), edited by Nippon Bohkin Bohbai Gakkai (1986), can be used.

The pH of the washing water in the processing of the present invention is generally from 4 to 9 and preferably from 5 to 8. The temperature and the time of the washing process can be selected variously according to the characteristics and the end use purpose of the photographic material to be processed, but is generally from 15° to 45° C. for 10 seconds to 5 minutes, and preferably from 25° to 40° C. for 15 seconds to 2 minutes.

The stabilizing solution can contain a dye stabilizer, for example, aldehydes such as formalin and glutaraldehyde, N-methylol compounds, hexamethylenetetramine or sulfite addition products of aldehyde. The stabilizing solution can contain, in addition to these, a pH buffer such as boric acid and sodium hydroxide; 1-hydroxyethylidene-1,1-diphosphonic acid; a chelating agent such as ethylenediaminetetraacetic acid; a sulfurization preventing agent such as alkanolamine; a brightening agent; and an antibacterial agent.

The overflow generated by the replenishment of the above described washing water and/or stabilizing solution can be reused in other processes such as a desilvering process, etc.

When the above each processing solution is concentrated due to evaporation by the processing using an automatic processor, etc., it is preferred to replenish an appropriate amount of water to compensate for the concentration.

The washing water and/or the stabilizing solution processed by a reverse osmosis membrane can effectively be used in the present invention. The materials which can be used for a reverse osmosis membrane include cellulose acetate, crosslinked polyamide, polyether, polysulfone, polyacrylic acid, and polyvinylene carbonate.

The solution feeding pressure in the use of these membranes is preferably from 2 to 10 kg/cm$^2$, particularly preferably from 3 to 7 kg/cm$^2$, taking into account the effect of stain prevention and the prevention of the reduction of the permeation amount of water.

The washing and/or the stabilizing process are preferably carried out by a multistage countercurrent system comprising a plurality of tanks, particularly using 2 to 5 tanks is preferred.

It is preferred to conduct the processing using a reverse osmosis membrane to water and/or solution in the second or after tanks in such a multistage countercurrent washing and/or stabilizing process. Specifically, the reverse osmosis membrane process is effected by processing the water in the tank (that is, in the second tank in the 2-tank system, the second or the third tank in the 3-tank system, or the third or the fourth tank in the 4-tank system) with a reverse osmosis membrane, and the water permeated the membrane is returned to the same tank (the tank from which the water to be processed is taken out; hereinafter referred to as the taking out tank) or the washing and/or the stabilizing tank positioned after therefrom. Further, it is one embodiment of the present invention to return the concentrated washing water and/or stabilizing solution to the bleach-fixing tank positioned upper side of the taking out tank.

A color developing agent may be included in a color photographic material for the simplification and speedup of the processing. Various precursors of the color developing agent are preferred for the inclusion, for example, the indoaniline based compounds disclosed in U.S. Pat. No. 3,342,597, the Schiff base type compounds disclosed in U.S. Pat. No. 3,342,599, RD, Nos. 14850 and 15159, the aldol compounds disclosed in RD, No. 13924, the metal salt complexes disclosed in U.S. Pat. No. 3,719,492, and the urethane based compounds disclosed in JP-A-53-135628 can be enumerated.

The color photographic material may contain, according to necessity, various 1-phenyl-3-pyrazolidones for accelerating the color development. Typical compounds therefor are disclosed in JP-A-56-64339, JP-A-57-144547 and JP-A-58-115438.

EXAMPLE

The present invention is described with reference to the example, however, it should not be construed as being limited thereto.

EXAMPLE 1

Preparation of Photographic Material

A surface of a paper support laminated on both sides with polyethylene was corona discharged. The support was provided with a gelatin subbing layer containing sodium dodecylbenzenesulfonate, and further, various photographic constitutional layers described below were coated to prepare a photographic material (Photographic Paper A). The coating solutions were prepared in the following manner.

Preparation of Coating Solution for First Layer 153.0 g of a yellow coupler (ExY), 15.0 g of a color image stabilizer (Cpd-1), 7.5 g of a color image stabilizer (Cpd-2), and 16.0 g of a color image stabilizer (Cpd-3) were dissolved in 25 g of a solvent (Solv-1), 25 g of a solvent (Solv-2) and 180 ml of ethyl acetate, and this solution was dispersed in an emulsified condition into 1,000 ml of a 10% aqueous solution of gelatin containing 60 ml of 10% sodium dodecylbenzenesulfonate and 10 g of citric acid to obtain an emulsified dispersion A.

On the other hand, silver chlorobromide emulsion A was prepared (cubic form, a mixture in a ratio of 3/7 (silver mol ratio) of a large grain size emulsion A having an average grain size of 0.88 μm and a small grain size emulsion A having an average grain size of 0.70 μm, variation coefficients of the grain size distribution of the large grain size emulsion A and the small grain size emulsion A of 0.08 and 0.10, respectively, and both emulsions containing 0.3 mol % of silver bromide localized at a part of the grain surface). The blue-sensitive Sensitizing Dyes A and B shown below were added in an amount of $2.0\times10^{-4}$ mol, respectively, per mol of silver, to the large grain size emulsion A, and $2.5\times10^{-4}$ mol, respectively, per mol of silver, to the small grain size emulsion A. Chemical ripening was conducted by addition of a sulfur sensitizer and a gold sensitizer.

The foregoing emulsified dispersion A was mixed with this silver chlorobromide emulsion A and dissolved to obtain a coating solution for the first layer having the composition described below.

Preparation of Coating Solutions for Second to Seventh Layers

The coating solutions for from the second to seventh layers were prepared in the same manner as the coating solution for the first layer.

The above each coating solution was coated on a support and the photographic sample having the composition shown below was prepared.

1-Oxy-3,5-dichloro-s-triazine sodium salt was used as a gelatin hardening agent in each layer.

Further, Cpd-14 and Cpd-15 were added to each layer so as to provide the total coating amount of 25.0 mg/m$^2$ and 50 mg/m$^2$, respectively.

The spectral sensitizing dyes described below were used in the silver chlorobromide emulsion of each light-sensitive emulsion layer.

TABLE 6

| Blue-Sensitive Emulsion Layer: |
|---|
| Sensitizing Dye A |

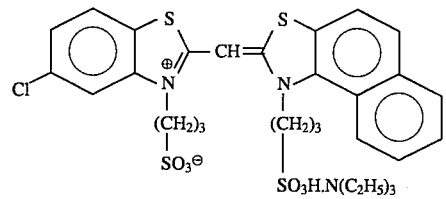

TABLE 6-continued

| Blue-Sensitive Emulsion Layer: |
|---|
| and<br>Sensitizing Dye B |

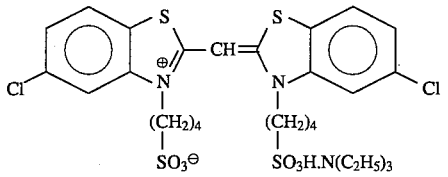

(in an amount of $2.0\times10^{-4}$ mol per mol of silver halide to the large grain size emulsion, and in an amount of $2.5\times10^{-4}$ mole per mol of silver halide to the small grain size emulsion)

TABLE 7

| Green-Sensitive Emulsion Layer: |
|---|
| Sensitizing Dye C |

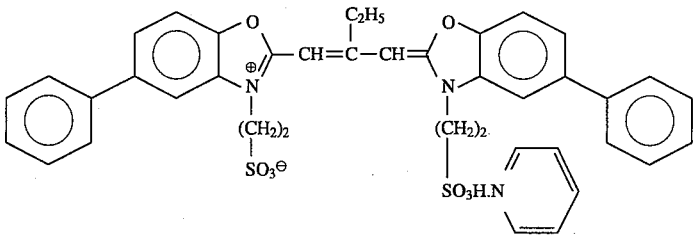

(in an amount of $4.0\times10^{-4}$ mol per mol of silver halide to the large grain size emulsion, and in an amount of $5.6\times10^{-4}$ mol per mol of silver halide to the small grain size emulsion)

Sensitizing Dye D

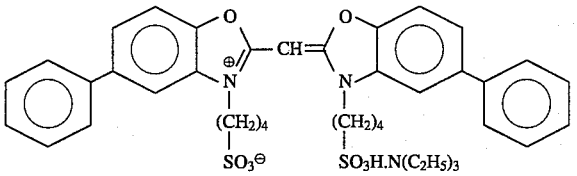

(in an amount of $7.0\times10^{-5}$ mol per mol of silver halide to the large grain size emulsion, and in an amount of $1.0\times10^{-5}$ mol per mol of silver halide to the small grain size emulsion)

TABLE 8

| Red-Sensitive Emulsion Layer: |
|---|
| Sensitizing Dye E |

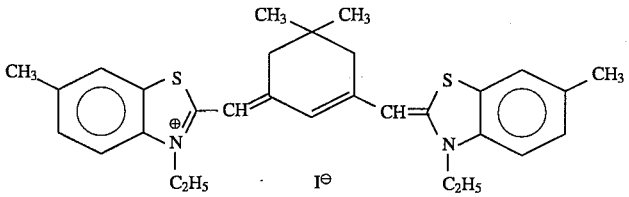

(in an amount of $0.9\times10^{-4}$ mol per mol of silver halide to the large grain size emulsion, and in an amount of $1.1\times10^{-4}$ mol per mol of silver halide to the small grain size emulsion)

Further, the following compound was added in an amount of $2.6\times10^{-3}$ mol per mol of silver halide.

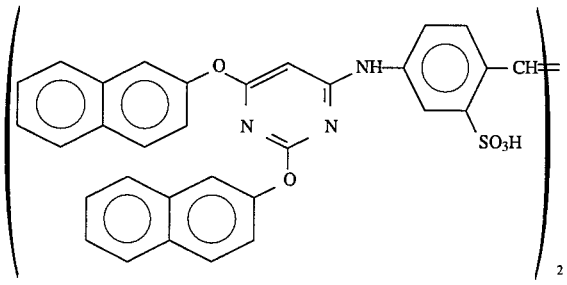

Further, 1-(5-methylureidophenyl)-5-mercaptotetrazole was added to the blue-sensitive emulsion layer, the green-sensitive emulsion layer and the red-sensitive emulsion layer in an amount of $8.5\times10^{-5}$ mol, $7.7\times10^{-4}$ mol and $2.5\times10^{-4}$ mol, respectively, per mol of silver halide.

In addition, 4-hydroxy-6-methyl-1,3,3a,7-tetra-azaindene was added to the blue-sensitive emulsion layer and the green-sensitive emulsion layer in an amount of $1\times10^{-4}$ mol and $2\times10^{-4}$ mol, respectively, per mol of silver halide.

Layer Constitution

The composition of each layer is described below. The numeral represents the coating amount g/m$^2$. The numeral for the silver halide emulsion represents the coating amount in terms of silver.

TABLE 9

| | |
|---|---|
| Support: | |
| Polyethylene-laminated paper (a white pigment ($TiO_2$) and a blue dye (ultramarine) were added to the polyethylene of the first layer side). | |
| First Layer (blue-sensitive emulsion layer) | |
| Silver Chlorobromide Emulsion A described above | 0.27 |
| Gelatin | 1.36 |
| Yellow Coupler (ExY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.13 |
| Solvent (Solv-2) | 0.13 |
| Second Layer (color mixture preventive layer) | |
| Gelatin | 1.00 |
| Color Mixture Preventive (Cpd-4) | 0.06 |
| Solvent (Solv-7) | 0.03 |
| Solvent (Solv-2) | 0.25 |
| Solvent (Solv-3) | 0.25 |

TABLE 10

| | |
|---|---|
| Third Layer (green-sensitive emulsion layer) | |
| Silver Chlorobromide Emulsion (cubic form, a mixture in a ratio of ⅓ (Ag mol ratio) of a large grain size emulsion B having an average grain size of 0.55 μm and a small grain size emulsion B having an average grain size of 0.39 μm, variation coefficients of the grain size distribution of the large grain size emulsion B and the small grain size emulsion B of 0.10 and 0.08, respectively, and both emulsions containing 0.8 mol % of AgBr localized at a part of the grain surface) | 0.13 |

TABLE 10-continued

| | |
|---|---|
| Gelatin | 1.45 |
| Magenta Coupler (ExM) | 0.16 |
| Color Image Stabilizer (Cpd-5) | 0.15 |
| Color Image Stabilizer (Cpd-2) | 0.03 |
| Color Image Stabilizer (Cpd-6) | 0.01 |
| Color Image Stabilizer (Cpd-7) | 0.01 |
| Color Image Stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (color mixture preventive layer) | |
| Gelatin | 0.70 |
| Color Mixture Preventive (Cpd-4) | 0.04 |
| Solvent (Solv-7) | 0.02 |
| Solvent (Solv-2) | 0.18 |
| Solvent (Solv-3) | 0.18 |

TABLE 11

| | |
|---|---|
| Fifth Layer (red-sensitive emulsion layer) | |
| Silver Chlorobromide Emulsion (cubic form, a mixture in a ratio of ¼ (Ag mol ratio) of a large grain size emulsion C having an average grain size of 0.50 μm and a small grain size emulsion C having an average grain size of 0.41 μm, variation coefficients of the grain size distribution of the large grain size emulsion C and the small grain size emulsion C of 0.09 and 0.11, respectively, and both emulsions containing 0.8 mol % of AgBr localized at a part of the grain surface) | 0.18 |
| Gelatin | 0.80 |
| Cyan Coupler (ExC) | 0.33 |
| Color Image Stabilizer (Cpd-1) | 0.35 |
| UV Absorbing Agent (UV-2) | 0.18 |
| Color Image Stabilizer (Cpd-9) | 0.15 |
| Color Image Stabilizer (Cpd-10) | 0.15 |
| Color Image Stabilizer (Cpd-11) | 0.01 |
| Solvent (Solv-6) | 0.22 |
| Color Image Stabilizer (Cpd-8) | 0.01 |
| Color Image Stabilizer (Cpd-6) | 0.01 |
| Solvent (Solv-l) | 0.01 |
| Sixth Layer (UV absorbing layer) | |
| Gelatin | 0.55 |
| UV Absorbing Agent (UV-1) | 0.38 |
| Color Image Stabilizer (Cpd-12) | 0.15 |
| Color Image Stabilizer (Cpd-5) | 0.02 |
| Seventh Layer (protective layer) | |
| Gelatin | 1.13 |
| Acryl-Modified Copolymer of Polyvinyl Alcohol (modification degree: 17%) | 0.05 |
| Liquid Paraffin | 0.02 |
| Color Image Stabilizer (Cpd-13) | 0.01 |

(ExY) Yellow Coupler

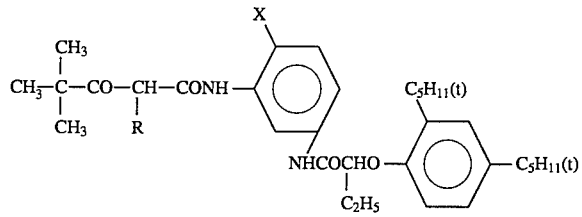

-continued

1/1 mixture (by mol ratio) of

R =

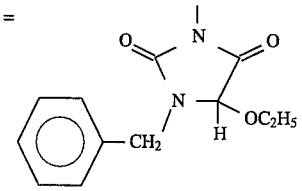

X = Cl and

R =

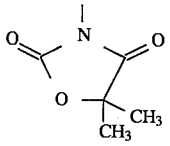

X = $OCH_3$ (ExM) Magenta Coupler

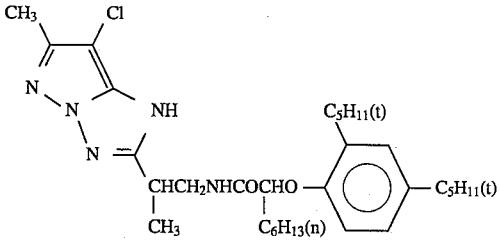

(ExC) Cyan Coupler

3/7 mixture (by mol ratio) of

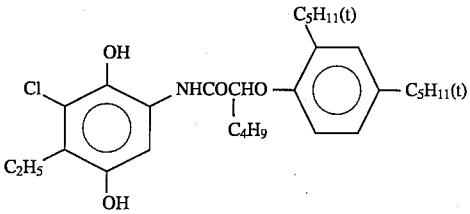

and

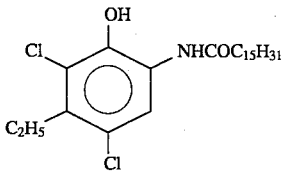

(Cpd-1) Color Image Stabilizer

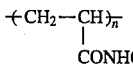

average molecular weight: 60,000

(Cpd-2) Color Image Stabilizer

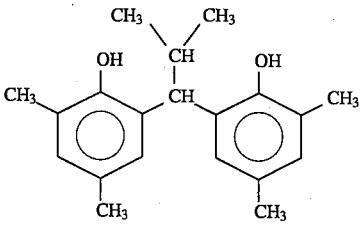

-continued (Cpd-3) Color Image Stabilizer

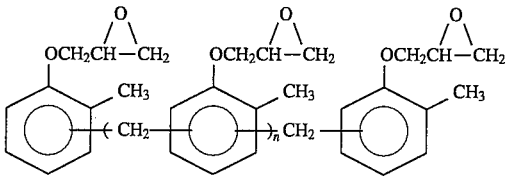

n = 7–8 (average value)

(Cpd-4) Color Mixture Preventive

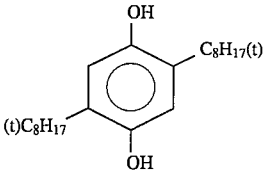

(Cpd-5) Color Image Stabilizer

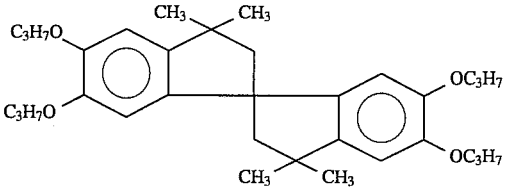

(Cpd-6) Color Image Stabilizer

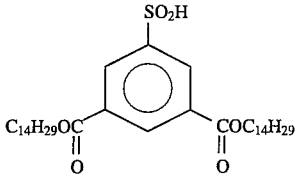

(Cpd-7) Color Image Stabilizer

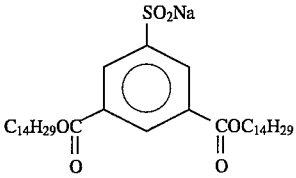

(Cpd-8) Color Image Stabilizer

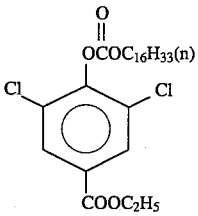

(Cpd-9) Color Image Stabilizer

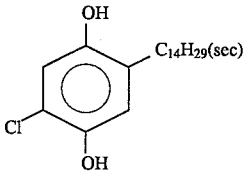

-continued (Cpd-10) Color Image Stabilizer

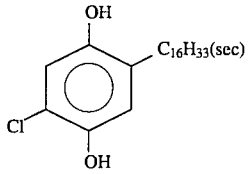

(Cpd-11) Color Image Stabilizer

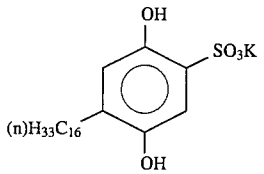

(Cpd-12) Color Image Stabilizer

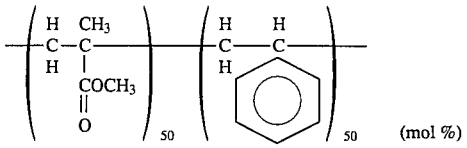

(mol %)

average molecular weight: 60,000

(Cpd-13) Color Image Stabilizer

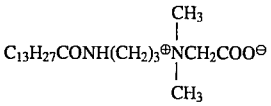

(Cpd-14) Preservative

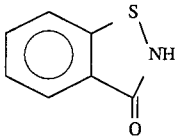

(Cpd-15) Preservative

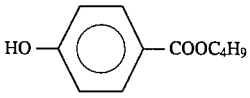

(UV-1) UV Absorbing Agent

10/5/1/5 mixture (by weight ratio) of (i)/(ii)/(iii)/(iv)

(i)

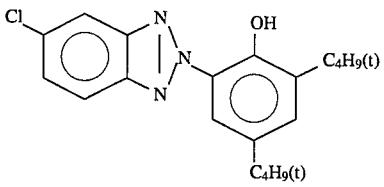

(ii)

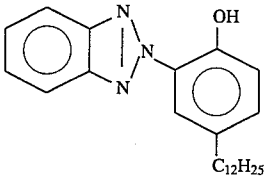

-continued (iii)

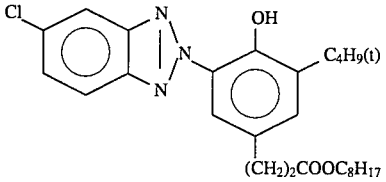

(iv)

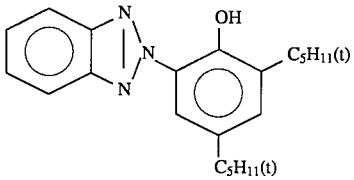

(UV-2) UV Absorbing Agent

1/2/2 mixture (by weight ratio) of (1)/(2)/(3)

(1)

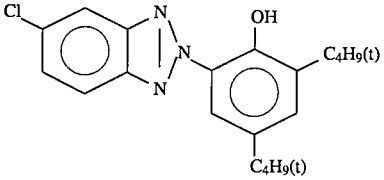

(2)

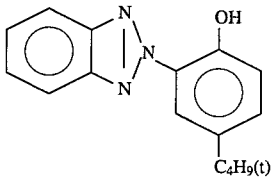

(3)

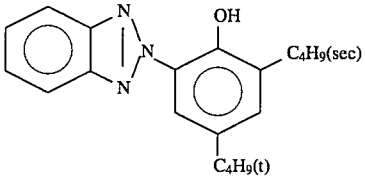

(Solv-1) Solvent

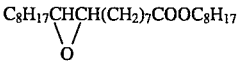

(Solv-2) Solvent

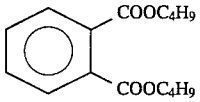

(Solv-3) Solvent

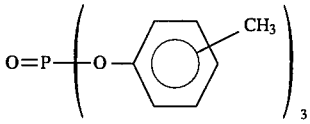

(Solv-4) Solvent
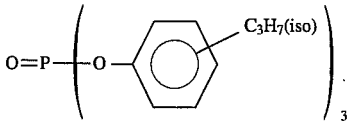
(Solv-5) Solvent
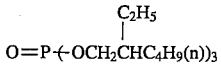
(Solv-6) Solvent
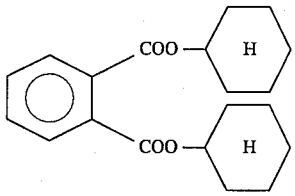
(Solv-7) Solvent
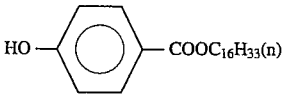
Further, the following irradiation preventing dyes were added to the emulsion and comparative photographic paper 101 was prepared.
| Dye No. | Coating Amount ($mg/m^2$) |
|---|---|
| III-1 | 10 |
| a-23 | 10 |
| a-2 | 20 |
| a-13 | 40 |
Dye III-1
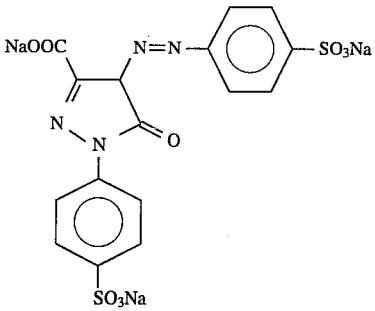
($10\ mg/m^2$)
Dye a-23
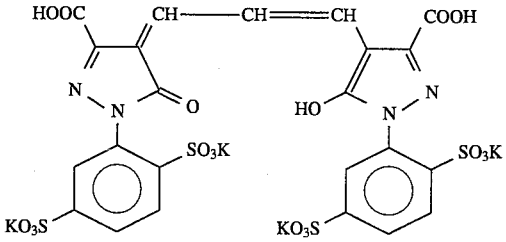
($10\ mg/m^2$)
Dye a-13
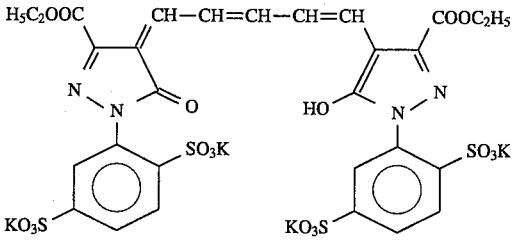
($40\ mg/m^2$)
Dye a-2

-continued

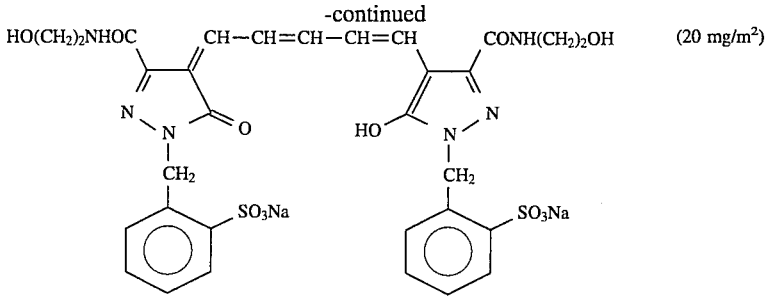

(20 mg/m²)

Sample Nos. 111 to 115 were prepared in the same manner as the preparation of Comparative Sample 101 except that the sensitizing dyes used in Comparative Sample 101 were replaced with the sensitizing dyes of the present invention as indicated in Table 12.

Processing Step

The processing steps are shown below.

| Step | Processing Temperature (°C.) | Processing Time (sec) | Replenishment Rate (ml/m²) | Tank Capacity (liter) |
|---|---|---|---|---|
| Color Development | 40 | 25 | 35 | 2 |
| Bleach-Fixing | 40 | 25 | 35 | 2 |
| Rinsing (1) | 35–40 | 15 | | 1 |
| Rinsing (2) | 35–40 | 15 | | 1 |
| Rinsing (3) | 35–40 | 15 | 60 | 1 |
| Drying | 80 | 20 | | |

(Rinsing step was carried out using the three stage countercurrent system of from tank (3) to tank (1).)

| | Tank Solution | Replenisher |
|---|---|---|
| Color Developing Solution | | |
| Water | 700 ml | 700 ml |
| Sodium Triisopropyl-naphthalene(β)sulfonate | 0.1 g | 0.1 g |
| Ethylenediaminetetraacetic Acid | 3.0 g | 3.0 g |
| Disodium 1,2-Dihydroxybenzene-4,6-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Sodium Sulfite | 0.1 g | 0.1 g |
| Disodium-N,N-bis(sulfonato-ethyl)hydroxylamine | 10.0 g | 13.0 g |
| N-Ethyl-N-(β-methanesulfon-amidoethyl)-3-methyl-4-amino-aniline Sulfate | 8.5 g | 17.0 g |
| Brightening Agent SR-13 | 2.5 g | 4.0 g |

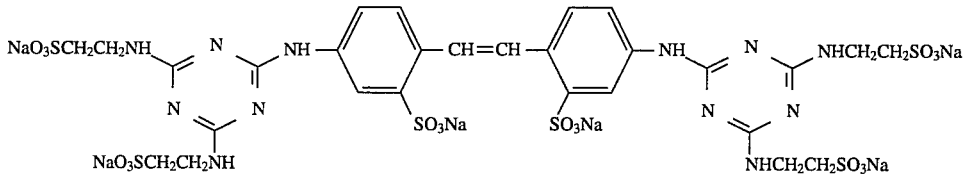

| | | |
|---|---|---|
| Water to make | 1,000 ml | 1,000 ml |
| pH (25° C.) | 10.35 | 11.6 |
| Bleach-Fixing Solution | | |
| Water | 600 ml | 150 ml |
| Ammonium Thiosulfate (700 g/liter) | 100 ml | 250 ml |
| Ammonium Sulfite | 15 g | 30 g |
| Ammonium Ethylenediamine-tetraacetate Iron(III) | 77 g | 150 g |
| Ethylenediaminetetraacetic Acid | 5 g | 12.5 g |
| Ammonium Bromide | 40 g | 75 g |
| Nitric Acid (67%) | 30 g | 65 g |
| Water to make | 1,000 ml | 1,000 ml |
| pH (25° C., adjusted with acetic acid or aqueous ammonia) | 5.8 | 5.6 |

Rinsing Solution

Ion exchange water (calcium and magnesium: 3 ppm or less, respectively)

The previously prepared A3 size photographic material was imagewise exposed using an enlarger and repeatedly processed according to the above processing step (running processing), and the running processing was continued until the total replenisher amount added reached one time of the capacity of each processing tank of the processor used (this was referred to as one cycle). When the ratio of the replenishment amount to the tank capacity differed in each processing tank, the running processing was continued until the ratio of the replenishment amount to the tank capacity for each tank reached 2 or more.

After the termination of the running processing, the color photographic paper which had been gradation exposed with an FW type sensitometer manufactured by Fuji Photo Film Co., Ltd. was processed using each processing solution. The reflection densities of yellow, magenta and cyan of the processed sample were measured to obtain the characteristic curves, and the minimum densities (Dmin) at that time were determined.

The results obtained are shown in Table 12.

TABLE 12

| Sample No. | Sensitizing Dye* Blue-Sensitive Layer | Green-Sensitive Layer | Red-Sensitive Layer | Residual color (Dmin) Yellow | Magenta | Cyan | Remarks |
|---|---|---|---|---|---|---|---|
| 101 | A, B | C, D | E | 0.13 | 0.09 | 0.13 | Comparison |
| 111 | 1–2, B | C, D | E | 0.08 | 0.09 | 0.13 | Invention |
| 112 | 1–4, B | C, D | E | 0.08 | 0.09 | 0.13 | " |
| 113 | A, B | 1–11,D | E | 0.13 | 0.07 | 0.13 | " |
| 114 | A, B | C, D | 1–22 | 0.13 | 0.09 | 0.12 | " |
| 115 | 1–2, 1—1 | 1–11 | 1–22 | 0.08 | 0.07 | 0.12 | " |

*: An addition amount of Compound 1–2 in Sample 111 was equimolar with that of Sensitizing Dye A in Comparative Sample 101.
An addition amount of Compound 1–4 in Sample 112 was equimolar with that of Sensitizing Dye A in Comparative Sample 101.
An addition amount of Compound 1–11 in Sample 113 was equimolar with that of Sensitizing Dye C in Comparative Sample 101.
An addition amount of Compound 1–22 in Sample 114 was equimolar with that of Sensitizing Dye E in Comparative Sample 101.
Addition amounts of Compounds 1–2, 1—1, 1–11 and 1–22 in Sample 115 were equimolar with those of Sensitizing Dyes A, B, C, E in Comparative Sample 101, respectively.

When the sensitizing dyes of the present invention were used, the white background having lower Dmin compared with the comparative sample could be obtained.

That is, it can be understood that the sensitizing dye of the present invention can provide a photographic paper which causes less residual color under the processing conditions of rapid processing and reduced replenishment compared with conventional sensitizing dyes.

EXAMPLE 2

The constitution of the present invention was applied to the color negative processing method as described below.

A multilayer color photographic material was prepared as Sample 201 by coating each layer having the following composition on an undercoated cellulose triacetate film support.

Composition of Light-Sensitive Layer

The main components for use in each layer are classified as follows:

ExC: Cyan Coupler

ExM: Magenta Coupler

ExY: Yellow Coupler

ExS: Sensitizing Dye

UV: Ultraviolet Absorber

HBS: High Boiling Point Organic Solvent

H: Hardening Agent for Gelatin

The numerical value corresponding to each component indicates the coated weight in units of $g/m^2$, and the coated weight is shown as the calculated weight in terms of silver in the case of silver halide. The coated weight is indicated in units of mol per mol of the silver halide in the same layer in the case of a sensitizing dye.

| | | |
|---|---|---|
| First Layer (antihalation layer) | | |
| Black Colloidal Silver | silver | 0.18 |
| Gelatin | | 1.40 |
| ExM-1 | | 0.18 |
| ExF-1 | | $2.0 \times 10^{-3}$ |

-continued

| | | |
|---|---|---|
| HBS-1 | | 0.20 |
| Second Layer (interlayer) | | |
| Silver Iodobromide Emulsion G | silver | 0.065 |
| 2,5-Di-t-pentadecylhydroquinone | | 0.18 |
| ExC-2 | | 0.020 |
| UV-1 | | 0.060 |
| UV-2 | | 0.080 |
| UV-3 | | 0.10 |
| HBS-1 | | 0.10 |
| HBS-2 | | 0.020 |
| Gelatin | | 1.04 |
| Third Layer (low sensivity red-sensitive emulsion layer) | | |
| Silver Iodobromide Emulsion A | silver | 0.25 |
| Silver Iodobromide Emulsion B | silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-7 | | 0.0050 |
| ExC-8 | | 0.010 |

| | | |
|---|---|---|
| Cpd-2 | | 0.025 |
| HBS-1 | | 0.10 |
| Gelatin | | 0.87 |
| Fourth Layer (middle sensitivity red-sensitive emulsion layer) | | |
| Silver Iodobromide Emulsion D | silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.025 |
| ExC-7 | | 0.0010 |
| ExC-8 | | 0.0070 |
| Cpd-2 | | 0.023 |
| HBS-1 | | 0.10 |
| Gelatin | | 0.75 |
| Fifth Layer (high sensitivity red-sensitive emulsion layer) | | |
| Silver Iodobromide Emulsion E | silver | 1.40 |
| ExS-1 | | $2.4 \times 10^{-4}$ |
| ExS-2 | | $1.0 \times 10^{-5}$ |
| ExS-3 | | $3.0 \times 10^{-4}$ |
| ExC-1 | | 0.12 |
| ExC-3 | | 0.045 |
| ExC-6 | | 0.020 |
| ExC-8 | | 0.025 |
| Cpd-2 | | 0.050 |
| HBS-1 | | 0.22 |
| HBS-2 | | 0.10 |
| Gelatin | | 1.20 |
| Sixth Layer (interlayer) | | |
| Cpd-1 | | 0.10 |
| HBS-1 | | 0.50 |
| Gelatin | | 1.10 |
| Seventh Layer (low sensitivity green-sensitive emulsion layer) | | |
| Silver Iodobromide Emulsion C | silver | 0.35 |
| ExS-4 | | $3.0 \times 10^{-5}$ |
| ExS-5 | | $2.1 \times 10^{-4}$ |
| ExS-6 | | $8.0 \times 10^{-4}$ |
| ExM-1 | | 0.010 |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| Eighth Layer (middle sensitivity green-sensitive emulsion layer) | | |
| Silver Iodobromide Emulsion D | silver | 0.80 |
| ExS-4 | | $3.2 \times 10^{-5}$ |
| EXS-5 | | $2.2 \times 10^{-4}$ |
| ExS-6 | | $8.4 \times 10^{-4}$ |
| ExM-2 | | 0.13 |
| ExM-3 | | 0.030 |
| ExY-1 | | 0.018 |
| HBS-1 | | 0.16 |
| HBS-3 | | $8.0 \times 10^{-3}$ |
| Gelatin | | 0.90 |
| Ninth Layer (high sensitivity green-sensitive emulsion layer) | | |
| Silver iodobromide Emulsion E | silver | 1.25 |
| ExS-4 | | $3.7 \times 10^{-5}$ |

| | | |
|---|---|---|
| ExS-5 | | $8.1 \times 10^{-5}$ |
| ExS-6 | | $3.2 \times 10^{-4}$ |
| ExC-1 | | 0.010 |
| ExM-1 | | 0.030 |
| ExM-4 | | 0.040 |
| ExM-5 | | 0.019 |
| Cpd-3 | | 0.040 |
| HBS-1 | | 0.25 |
| HBS-2 | | 0.10 |
| Gelatin | | 1.44 |
| Tenth Layer (yellow filter layer) | | |
| Yellow Colloidal Silver | silver | 0.030 |
| Cpd-1 | | 0.16 |
| HBS-1 | | 0.60 |
| Gelatin | | 0.60 |
| Eleventh Layer (low sensitivity blue-sensitive emulsion layer) | | |
| Silver Iodobromide Emulsion C | silver | 0.18 |
| ExS-7 | | $8.6 \times 10^{-4}$ |
| ExY-1 | | 0.020 |
| ExY-2 | | 0.22 |
| ExY-3 | | 0.50 |
| ExY-4 | | 0.020 |
| HBS-1 | | 0.28 |
| Gelatin | | 1.10 |
| Twelfth Layer (medium sensitivity blue-sensitive emulsion layer) | | |
| Silver Iodobromide Emulsion D | silver | 0.40 |
| ExS-7 | | $7.4 \times 10^{-4}$ |
| ExC-7 | | $7.0 \times 10^{-3}$ |
| ExY-2 | | 0.050 |
| ExY-3 | | 0.10 |
| HBS-1 | | 0.050 |
| Gelatin | | 0.78 |
| Thirteenth Layer (high sensitivity blue-sensitive emulsion layer) | | |
| Silver Iodobromide Emulsion F | silver | 1.00 |
| ExS-7 | | $4.0 \times 10^{-4}$ |
| ExY-2 | | 0.10 |
| ExY-3 | | 0.10 |
| HBS-1 | | 0.070 |
| Gelatin | | 0.86 |
| Fourteenth Layer (first protective layer) | | |
| Silver Iodobromide Emulsion G | silver | 0.20 |
| UV-4 | | 0.11 |
| UV-5 | | 0.17 |
| HBS-1 | | $5.0 \times 10^{-2}$ |
| Gelatin | | 1.00 |
| Fourteenth Layer (second protective layer) | | |
| H-1 | | 0.40 |
| B-1 (diameter: 1.7 μm) | | $5.0 \times 10^{-2}$ |
| B-2 (diameter: 1.7 μm) | | 0.10 |
| B-3 | | 0.10 |
| S-1 | | 0.20 |
| Gelatin | | 1.20 |

Further, W-1 to W-3, B-4 to B-6, F-1 to F-17, and iron salt, lead salt, gold salt, platinum salt, iridium salt, and rhodium salt were included in all of the layers to improve storage stability, processability, pressure resistance, fungicidal and biocidal properties, antistatic properties and coating properties.

TABLE 13

| Emulsion | Average AgI Content (%) | Average Grain Size (μm) | Variation Coefficient of the Grain Size (%) | Diameter/ Thickness Ratio | Silver Amount Ratio [core/middle/shell] (AgI content) | Grain Structure and Form |
|---|---|---|---|---|---|---|
| A | 4.0 | 0.45 | 27 | 1 | [1/3] (13/1) | double structure, octahedral grain |
| B | 8.9 | 0.70 | 14 | 1 | [3/7] (25/2) | double structure, octahedral grain |
| C | 2.0 | 0.55 | 25 | 7 | — | uniform structure, tabular grain |
| D | 9.0 | 0.65 | 25 | 6 | [12/59/29] (0/11/8) | triple structure, tabular grain |
| E | 9.0 | 0.85 | 23 | 5 | [8/59/33] (0/11/8) | triple structure, tabular grain |
| F | 14.5 | 1.25 | 25 | 3 | [37/63] (34/3) | double structure, tabular grain |
| G | 1.0 | 0.07 | 15 | 1 | — | uniform structure, fine grain |

In Table 13, (1) Emulsions A to F were subjected to reduction sensitization during preparation of the grains with thiourea dioxide and thiosulfonic acid according to the examples of JP-A-2-191938 (corresponding to U.S. Pat. No. 5,061,614).

(2) Emulsions A to F were subjected to gold sensitization, sulfur sensitization and selenium sensitization in the presence of the spectral sensitizers indicated in each light-sensitive layer and sodium thiocyanate according to the examples of JP-A-3-237450 (corresponding to EP-A-443453).

(3) Low molecular weight gelatin was used in the preparation of tabular grains according to the examples of JP-A-1-158426.

(4) There were observed, using a high pressure electron microscope, such dislocation lines as disclosed in JP-A-3-237450 (corresponding to EP-A-443453) in tabular grains and regular crystal grains having a grain structure.

ExC-1

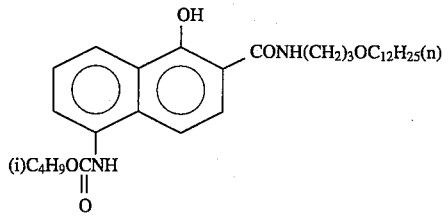

ExC-2

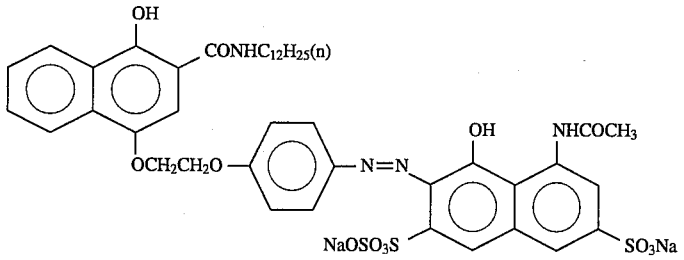

ExC-3

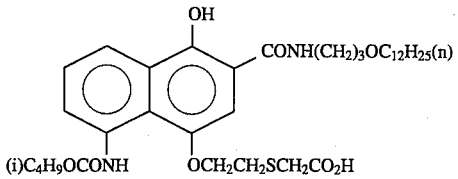

ExC-4

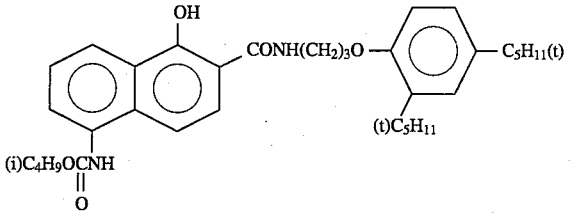

-continued
ExC-5
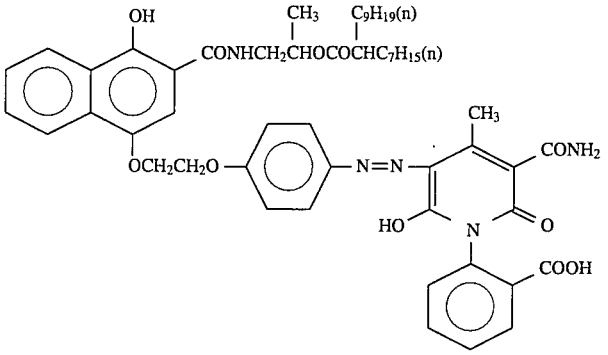
ExC-6
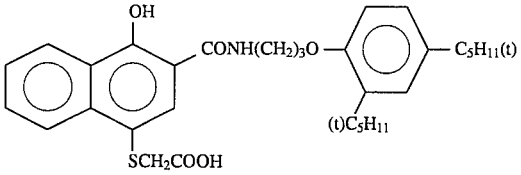
ExC-7
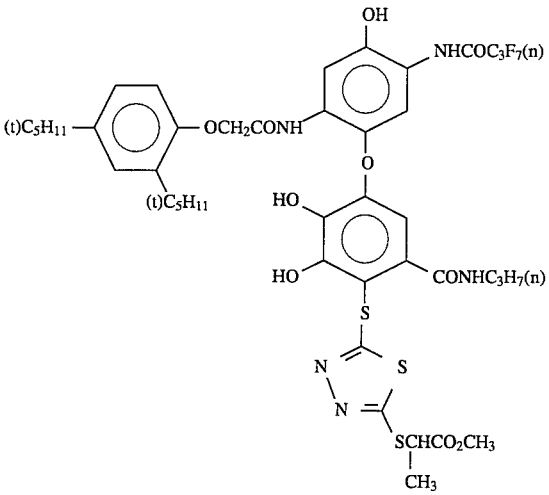
ExC-8
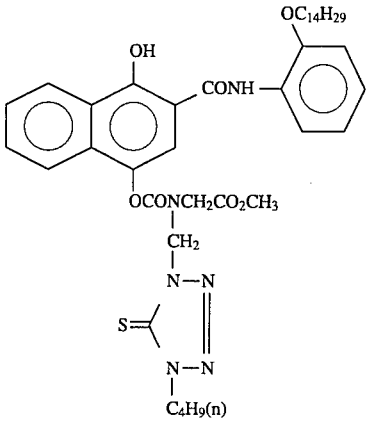

-continued
ExM-1
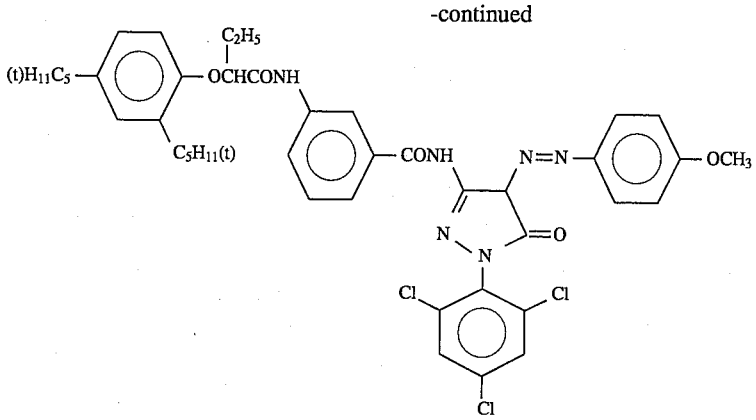
ExM-2
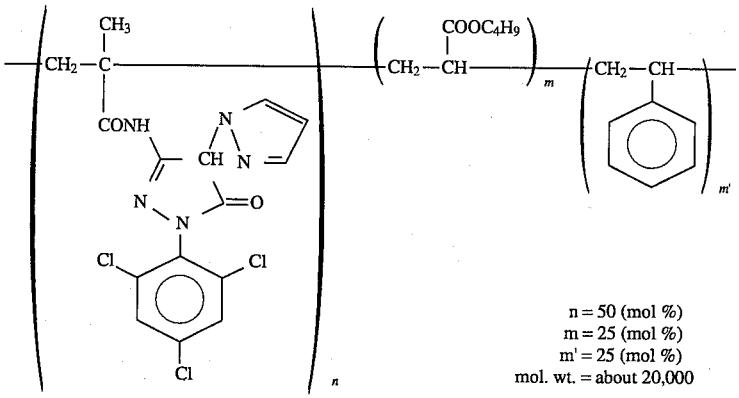
n = 50 (mol %)
m = 25 (mol %)
m' = 25 (mol %)
mol. wt. = about 20,000
ExM-3
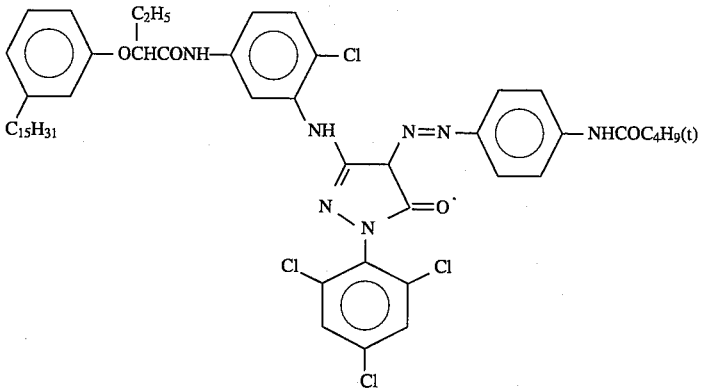
ExM-4
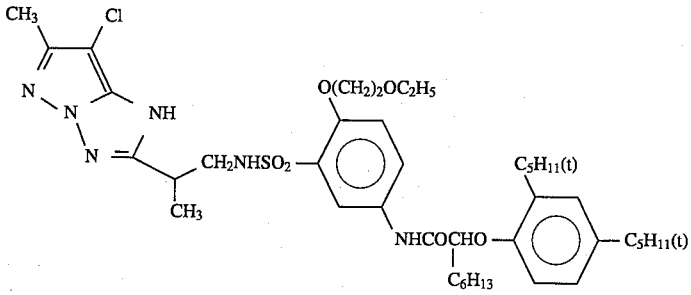

-continued
ExM-5
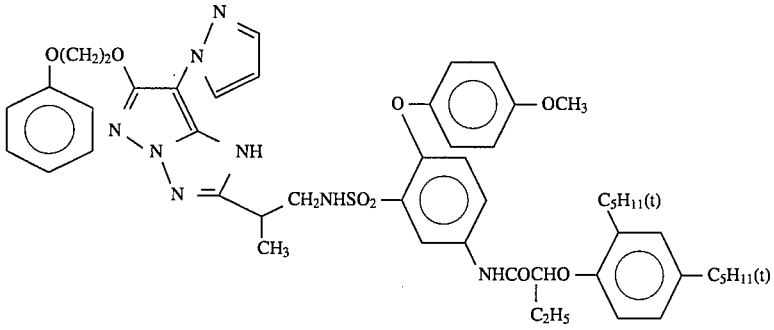
ExY-1
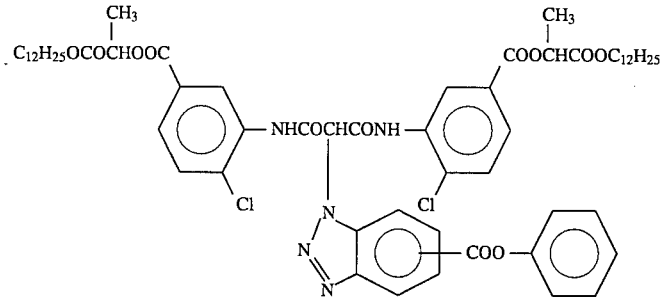
ExY-2
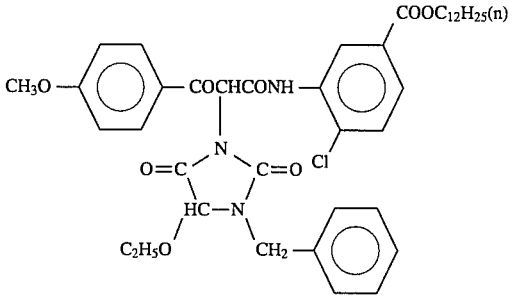
ExY-3
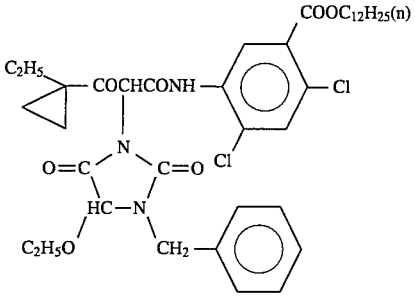
ExY-4
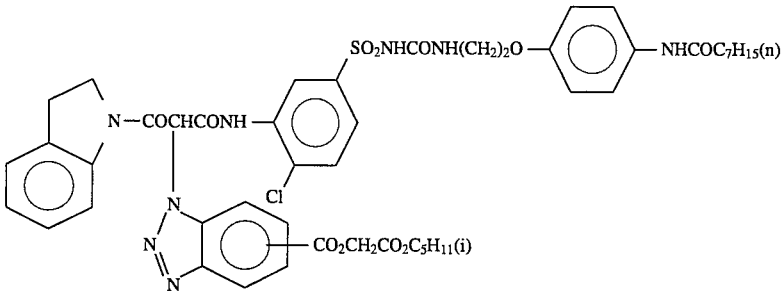

-continued
ExF-1
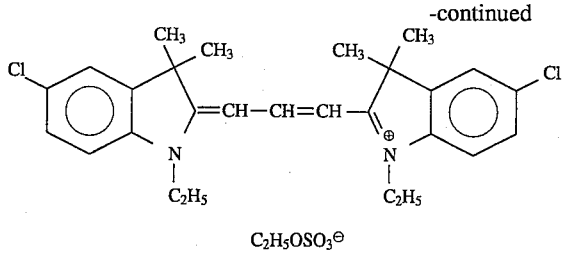
$C_2H_5OSO_3^{\ominus}$
Cpd-1
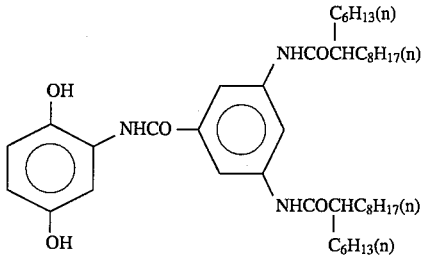
Cpd-2
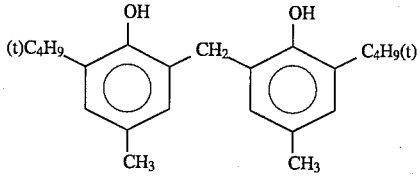
Cpd-3
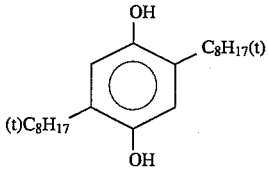
UV-1
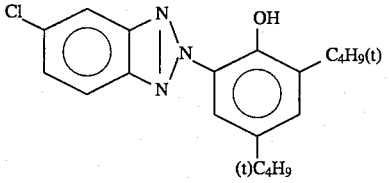
UV-2
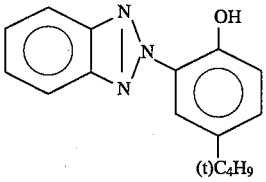
UV-3
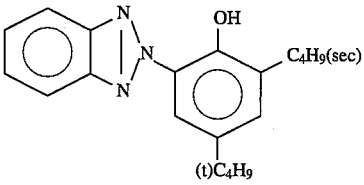
UV-4
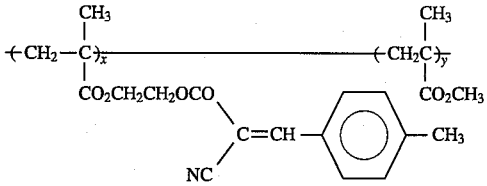
x:y = 70:30 (wt %)

-continued
UV-5
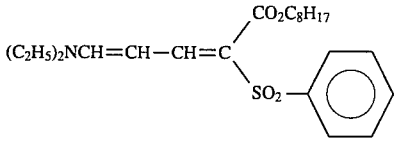
Tricresyl Phosphate HBS-1
Di-n-butyl Phthalate HBS-2
HBS-3
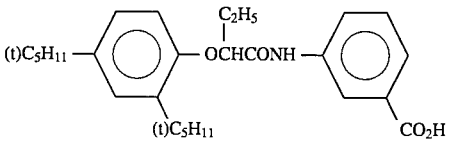
ExS-1
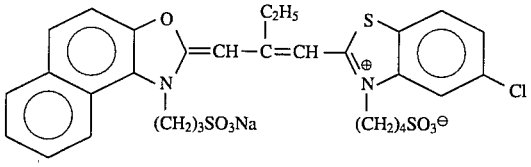
ExS-2
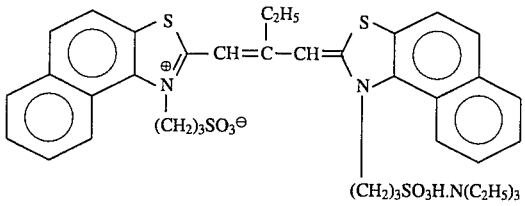
ExS-3
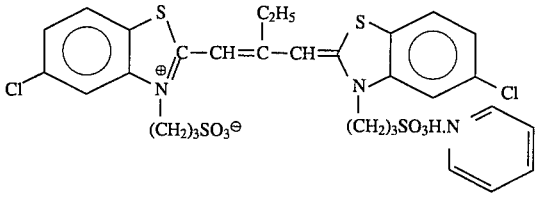
ExS-4
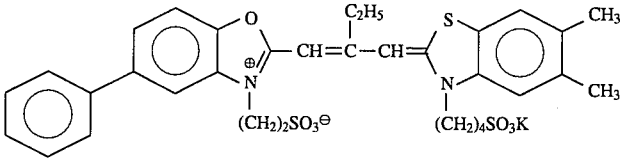
ExS-5
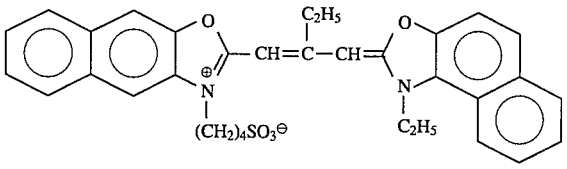
ExS-6
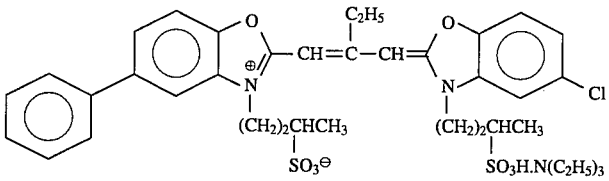
ExS-7
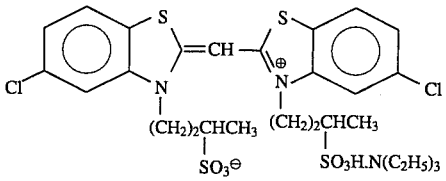

-continued
S-1
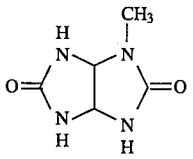
H-1
$CH_2{=}CH{-}SO_2{-}CH_3{-}CONH{-}CH_2$
$CH_2{=}CH{-}SO_2{-}CH_2{-}CONH{-}CH_2$
B-1
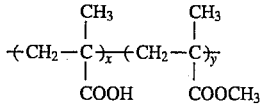
x/y = 10/90 (mol %)
B-2
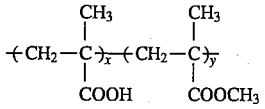
x/y = 40/60 (mol %)
B-3
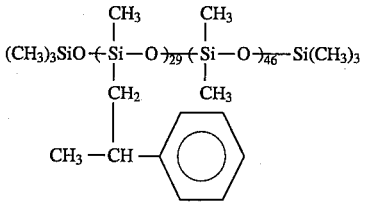
(mol %)
B-4
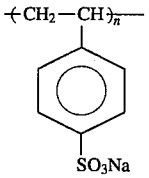
(n = an integer of ca. 1,000)
B-5
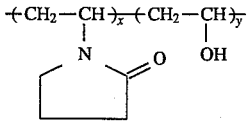
x/y = 70/30 (mol %)
B-6
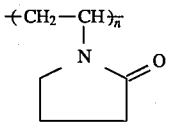
(mol. wt. about 10,000)
(n = an integer)
W-1
$C_8F_{17}SO_2NHCH_2CH_2CH_2OCH_2CH_2\overset{\oplus}{N}(CH_3)_3$
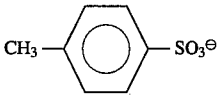
W-2
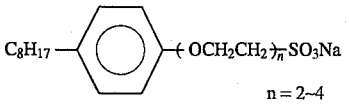
n = 2~4
W-3
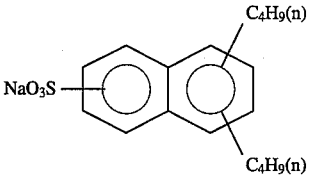

-continued
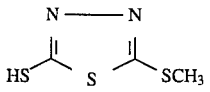
F-1
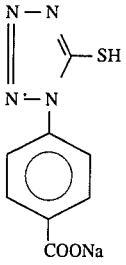
F-2
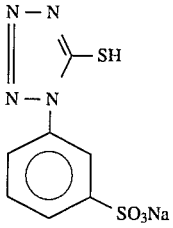
F-3
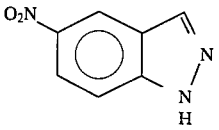
F-4
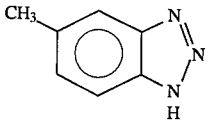
F-5
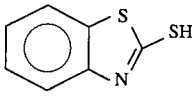
F-6
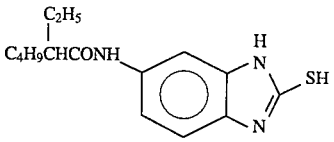
F-7
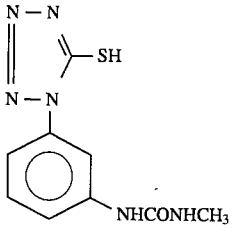
F-8
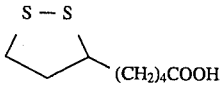
F-9
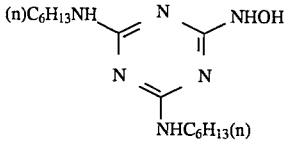
F-10

-continued

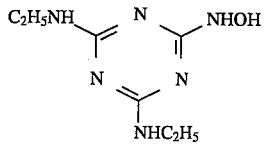

F-11

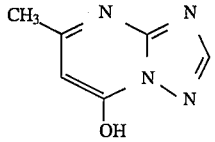

F-12

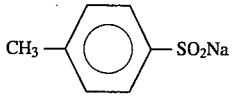

F-13

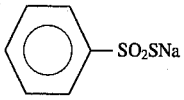

F-14

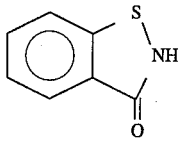

F-15

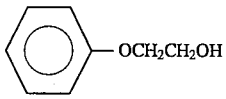

F-16

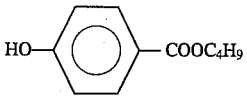

F-17

The above prepared sample was imagewise exposed and continuously processed using the following processing solutions until the replenishment amount of the bleach-fixing solution reached 10 times of the tank capacity.

The bleach-fixing solution was silver recovered by an in-line silver recovering apparatus and the solution after silver recovery was regenerated and reused as a bleach-fixing solution replenisher. The silver recovering apparatus was a small size electrolytic silver recovering apparatus, an anode was made of carbon and a cathode was a stainless drum, the current density in use was 0.5 A/dm$^2$. The detail about the apparatus for silver recovery is disclosed in JP-A-6-175305, FIG. 1.

The overflow of the bleach-fixing solution is directly connected with the silver recovering apparatus and the solution after electrolytic treatment is returned to the former bleach-fixing tank by pump 1 through filter.

600 ml per 1 liter of the overflow from the silver recovering apparatus is recovered to a regenerating tank, and when the recovered amount reaches 1 liter, air is blown in for about 2 hours, a regenerant is added and sent to the replenishing tank of the bleach-fixing solution by pump 2. The remainder of the solution is discharged and after silver is recovered separately, discarded as waste solution. The amount of the waste solution was 196 ml per square meter processing of Sample 101.

Washing process was carried out by a counter-current cascade system using 5 stage multichamber washing tank arranged in-line. The overflow of the first washing water was cascaded to the prebath, the bleach-fixing tank. A reverse osmosis apparatus RC30 (a product of Fuji Photo Film Co., Ltd.) was installed between the fourth and fifth washing tanks. The processing step is shown below. The detail of the processor used is disclosed in JP-A-6-175305, FIG. 2.

| | Processing Step | | | |
|---|---|---|---|---|
| Step | Processing Time (sec) | Processing Temperature (°C.) | Replenishment Rate* (ml) | Tank Capacity (liter) |
| Color Development | 60 | 48.5 | 80 | 2 |
| Bleach-Fixing | 60 | 48.5 | 200 | 2 |
| Washing (1) | 15 | 45 | — | 0.5 |
| Washing (2) | 15 | 45 | — | 0.5 |
| Washing (3) | 15 | 45 | — | 0.5 |
| Washing (4) | 15 | 45 | — | 0.5 |
| Washing (5) | 15 | 45 | 104 | 0.5 |

-continued

| Step | Processing Time (sec) | Processing Temperature (°C.) | Replenishment Rate* (ml) | Tank Capacity (liter) |
|---|---|---|---|---|
| | Processing Step | | | |
| Stabilization | 2 | room temperature | 30 | coating |
| Drying | 50 | 80 | | |

*Replenishment rate per $m^2$ of the photographic material

The crossover time from color development to bleach-fixing, and from bleach-fixing to first washing was 3 seconds. Further, the average amount of carry-over per m of the photographic material was 68 ml.

In addition, the temperature and the humidity out of the processor were measured using a thermometer and a hygrometer and the evaporation amount was determined and each tank was compensated for evaporated amount as disclosed in JP-A-3-280042. The above described ion exchange water for washing water was used as the water for evaporation compensation.

| Color Developing Solution | Tank Solution (g) | Replenisher (g) |
|---|---|---|
| Diethylenetriaminepentaacetic Acid | 4.0 | 4.0 |
| 1-Hydroxyethylidene-1,1-diphosphonic Acid | 2.7 | 3.0 |
| Potassium Hydroxide | 3.0 | 4.5 |
| Sodium Sulfite | 4.0 | 9.5 |
| Sodium Bicarbonate | 1.8 | — |
| Potassium Carbonate | 31.7 | 39.0 |
| Potassium Bromide | 6.5 | — |
| Potassium Iodide | 1.3 mg | — |
| N-Methylhydroxylamine Hydrochloride | 5.0 | 9.0 |
| 2-Methyl-4-[N-ethyl-N-(β-hydroxyethyl)amino]aniline Sulfate | 13.0 | 24.0 |
| Water to make | 1.0 l | 1.0 l |
| pH | 10.05 | 12.10 |

| Bleach-Fixing Solution | Tank Solution (g) | Replenisher (g) (at start) |
|---|---|---|
| Fixing Agent (Compound A) | 1.8 mol | 2.97 mol |

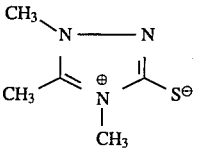

| | | |
|---|---|---|
| Ammonium 1,3-Propylenediaminetetraacetato Ferrate Monohydrate | 144.0 | 237.6 |
| Ammonium Bromide | 40.0 | 66.0 |
| Ammonium Nitrate | 20.0 | 33.0 |
| Water to make | 1.0 l | 1.0 l |
| pH (25° C.) (adjusted with acetic acid and aqueous ammonia) | 4.5 | 4.4 |

Bleach-Fixing Regenerant

| | |
|---|---|
| The addition amount per liter of the recovered solution for regeneration (g) | |
| Ammonium 1,3-Propylenediaminetetraacetato Ferrate Monohydrate | 93.6 |
| Fixing Agent (Compound A shown above) | 1.17 mol |
| Ammonium Bromide | 26 |
| Ammonium Nitrate | 13 |

Washing Water

City water was passed through a mixed bed column packed with an H-type strongly acidic cation exchange resin (Amberlite IR-120B of Rohm & Haas) and an OH-type strongly basic anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 150 mg/liter of sodium sulfate were added thereto. The pH of this washing water was in the range of from 6.5 to 7.5.

Stabilizing Solution (replenisher is the same with the tank solution)

| | unit: g |
|---|---|
| Sodium p-Toluenesulfinate | 0.03 |
| Polyoxyethylene-p-monononylphenyl Ether (average polymerization degree: 10) | 0.2 |
| Disodium Ethylenediaminetetraacetate | 0.05 |
| 1,2-Benzisothiazoline-3-one | 0.03 |
| 1,2,4-Triazole | 1.3 |
| 1,4-Bis(1,2,4-triazol-1-ylmethyl)-piperazine | 0.75 |
| Water to make | 1.0 liter |
| pH | 8.5 |

The amount of the waste solution after 100 $m^2$ of the above sample was processed according to the above processing system was 19.6 liters. This corresponds to about one thirteenth of the total amount of the waste solution by ordinary processing system (about 250 liters), for example, a color negative film processing CN-16FA system (a product of Fuji Photo Film Co., Ltd.), this shows conspicuous reduction of the amount of the waste solution. Comparative Sample 201 and Samples 211 to 212 of the present invention which had been gradation exposed through optical wedge were processed using the above running solutions after the continuous processing and the degree of the residual colors was visually compared. The photographic materials containing the dyes represented by formula (I) of the present invention provided less residual colors compared with the photographic materials containing the conventional dyes. Further, the dyes used were indicated in Table 14.

TABLE 14

| Sample No. | Sensitizing Dye* Red-Sensitive Layer | Green-Sensitive Layer | Blue-Sensitive Layer | Residual Color | Remarks |
|---|---|---|---|---|---|
| 201 | ExS-1<br>ExS-2<br>ExS-3 | ExS-4<br>ExS-5<br>ExS-6 | ExS-7 | Significant | Comparison |

TABLE 14-continued

| Sample No. | Sensitizing Dye* Red-Sensitive Layer | Green-Sensitive Layer | Blue-Sensitive Layer | Residual Color | Remarks |
|---|---|---|---|---|---|
| | 1–23 | 1–25 | 1—1 | None | Invention |
| 211 | 1–21 | 1–24 | | | |
| | 1–6 | 1–12 | | | |
| | ExS-1 | ExS-4 | ExS-7 | Extremely Little | Invention |
| 212 | 1–21 | ExS-5 | | | |
| | ExS-3 | 1–12 | — | | |

*Addition amounts were equimolar with the comparative sample.

EXAMPLE 3

Preparation of Tabular Grains 6 g of potassium bromide and 7 g of low molecular weight gelatin having an average molecular weight of 15,000 were added to 1 liter of water, and 37 ml of an aqueous solution of silver nitrate (silver nitrate: 4.00 g) and 38 ml of an aqueous solution containing 5.9 g of potassium bromide were added, with stirring, to the vessel maintained at 55° C. by a double jet method over 37 seconds. Subsequently, 18.6 g of gelatin was added thereto and the temperature was raised to 70° C., then 89 ml of an aqueous solution of silver nitrate (silver nitrate: 9.8 g) was added over 22 minutes. 7 ml of a 25% aqueous solution of ammonia was added to the mixture, and physical ripening was carried out for 10 minutes while maintaining the temperature at 70° C., then 6.5 ml of a 100% solution of acetic acid was added. Subsequently, an aqueous solution containing 153 g of silver nitrate and an aqueous solution of potassium bromide were added thereto by a controlled double jet method over 35 minutes with maintaining pAg at 8.5. Then, 15 ml of a solution of 2 N potassium thiocyanate was added. After physical ripening was carried out over 5 minutes at that temperature, the temperature was lowered to 35° C. The thus obtained grains were monodisperse pure silver bromide tabular grains having an average projected area diameter of 1.10 μm, a thickness of 0.145 μm, and a variation coefficient of a diameter of 18.5%.

Then, soluble salts were removed by flocculation. The temperature was again raised to 40° C., and 30 g of gelatin, 2.35 g of phenoxyethanol and 0.8 g of sodium polystyrenesulfonate as a tackifier were added, and pH and pAg were adjusted to 5.90 and 8.00, respectively, with sodium hydroxide and a silver nitrate solution.

This emulsion was subjected to chemical sensitization while stirring with maintaining the temperature at 56° C. At first, $1\times10^{-5}$ mol/mol Ag of Thiosulfonic Acid Compound-I, Thiosulfonic Acid Compound-I $C_2H_5SO_2SNa$ was added, then 0.1 mol% of AgI fine grains was added, further, 0.043 mg of thiourea dioxide was added, and the emulsion was allowed to stand for 22 minutes and reduction sensitization was conducted. Then, 20 mg of 4-hydroxy-6-methyl-1,3,3a,7-tetraazaindene and 400 mg of Sensitizing Dye-I Sensitizing Dye-I

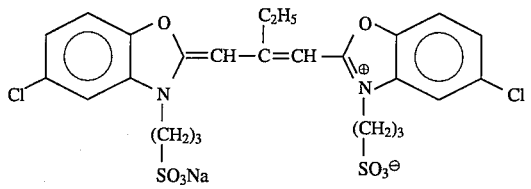

were added. Further, 0.83 g of calcium chloride was added. Subsequently, 1.3 mg of sodium thiosulfate, 1.9 mg of Selenium Compound-I, 2.6 mg of chloroauric acid and 90 mg of potassium thiocyanate were added, and after 40 minutes, the temperature was lowered to 35° C.

Thus, Tabular Grain T-1 was prepared.

Selenium Compound-I

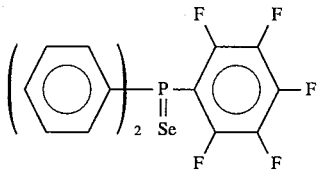

Preparation of Coated Sample

The following chemicals were added to T-1 per mol of the silver halide of T-1 to obtain a coating solution and a coated sample was prepared.

| | |
|---|---|
| Gelatin (including gelatin in the emulsion) | 108 g |
| Trimethylolpropane | 9 g |
| Dextran (average molecular weight: 39,000) | 18.5 g |
| Sodium Polystyrenesulfonate (average molecular weight: 600,000) | 1.8 g |
| Hardening Agent, 1,2-Bis(vinylsulfonylacetamido)ethane | Amount added was adjusted as to obtain a swelling rate of 230% |
| Compound-I | 34 mg |
| Compound-II | 4.8 g |
| Compound-III | 15 mg |

Compound-I

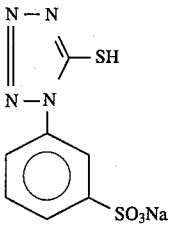

Compound-II

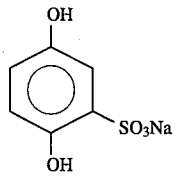

Compound-III

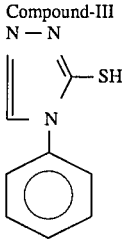

Dye Emulsion A was added to the above coating solution as to provide a coating weight of Dye-I of 10 mg/m$^2$ per one side.

Dye-I

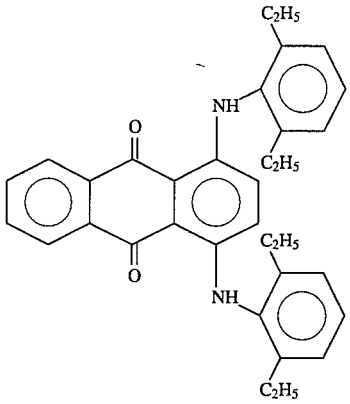

(1) Preparation of Dye Emulsion A 60 g of the above Dye-I, 62.8 g of the following High Boiling Point Organic Solvent-I, 62.8 g of the following High Boiling Point Organic Solvent-II, and 333 g of ethyl acetate were dissolved at 60° C. Then, 65 ml of a 5% aqueous solution of dodecylbenzenesulfonate, 94 g of gelatin and 581 ml of water were added to the solution, and dispersed in an emulsion condition using a dissolver at 60° C. over 30 minutes. Then, 2 g of the following Compound-IV and 6 liters of water were added thereto and the temperature was lowered to 40° C. Subsequently, the emulsion was concentrated until the total weight reached 2 kg using ultrafiltration labo module ACP1050 manufactured by Asahi Kasei Industry Co., Ltd., and 1 g of the following Compound-IV was added thereto to obtain Dye Emulsion A.

High Boiling Point Organic Solvent-I

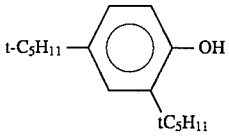

High Boiling Point Organic Solvent-II

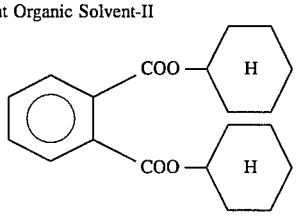

Compound-IV

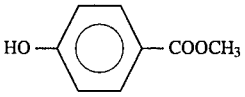

The surface protective layer was prepared so that the coating weight of each component became as indicated below.

| | |
|---|---|
| Gelatin | 0.78 g/m$^2$ |
| Sodium Polyacrylate (average molecular weight: 400,000) | 0.080 g/m$^2$ |
| 4-Hydroxy-6-methyl-1,3,3a,7-tetraazaindene | 0.015 g/m$^2$ |
| Coating Aid-I | 0.013 g/m$^2$ |
| Coating Aid-II | 0.045 g/m$^2$ |
| Coating Aid-III | 0.0065 g/m$^2$ |
| Coating Aid-IV | 0.003 g/m$^2$ |
| Coating Aid-V | 0.001 g/m$^2$ |
| Compound-V | 1.7 mg/m$^2$ |
| Compound-VI | 100 mg/m$^2$ |
| Polymethyl Methacrylate (average grain size: 3.7 μm) | 0.087 g/m$^2$ |
| Proxel (pH was adjusted to 7.4 with NaOH) | 0.0005 g/m$^2$ |

Coating Aid-I

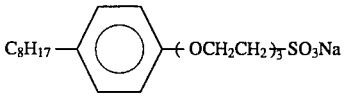

Coating Aid-II $C_{16}H_{33}O(CH_2CH_2O)_{10}H$

Coating Aid-III $C_{17}H_{33}CON(CH_3)CH_2CH_2SO_3Na$

Coating Aid-IV $C_8F_{17}SO_2N(C_3H_7)(CH_2CH_2O)_{16}H$

Coating Aid-V $C_8F_{17}SO_2N(C_3H_7)(CH_2CH_2O)_4(CH_2)_4SO_3Na$

Compound V

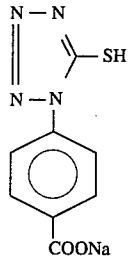

-continued

| | |
|---|---|
| Compound-VI | 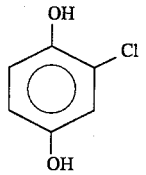 |

Preparation of Support (1) Preparation of Dye Dispersion B for Subbing Layer

The following Dye-II was treated by a ball mill according to JP-A-63-197943.

Dye-II

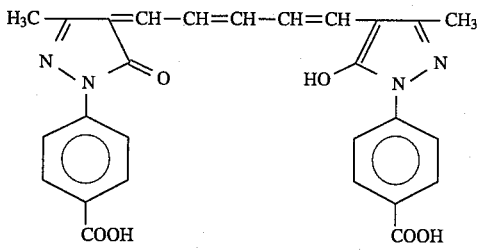

434 ml of water and 791 ml of a 6.7% aqueous solution of surfactant Triton X-200 (TX-200) were put in a ball mill (volume: 2 liters). 20 g of the dye was added to the solution. 400 ml of beads of zirconium oxide ($ZrO_2$) (diameter: 2 mm) was added thereto and the content was pulverized over 4 days. After that, 160 g of a gelatin hydrogel containing 12.5% of gelatin was added. After defoaming, $ZrO_2$ beads were removed by filtration. As a result of the observation, the diameter of the pulverized dye accounted for a wide range of from 0.05 to 1.15 μm and the average grain size was 0.37 μm.

The dye grains of 0.9 μm or more were removed by centrifugal operation.

Thus, Dye Dispersion D was obtained.

(2) Preparation of Support

A biaxially stretched polyethylene terephthalate film having a thickness of 175 μm was corona discharged, the first subbing layer having the following composition was coated by a wire bar coater so that the coating amount reached 4.9 ml/m$^2$, and then dried at 185° C. for 1 minute.

Then, the first subbing layer was also coated on the opposite side similarly. The polyethylene terephthalate used contained 0.04 wt% of Dye-I.

| | |
|---|---|
| Solution of Butadiene-Styrene Copolymer Latex (solid part: 40%, weight ratio of butadiene/styrene = 31/69) | 158 ml |
| A 4% Solution of Sodium 2,4-Dichloro-6-hydroxy-s-triazine | 41 ml |
| Distilled Water | 801 ml |

*In a latex solution, 0.4 wt%, based on the solid part of the latex, of the following compound was contained as an emulsifying dispersant.

Emulsifying Dispersant $$\begin{array}{l} n\text{-}C_6H_{13}OOCCH_2 \\ \quad\quad\quad\quad | \\ n\text{-}C_6H_{13}OOCCH\text{—}SO_3Na \end{array}$$

On the first subbing layers of the above both surfaces were coated the second subbing layer having the following composition so as to provide the coating amount indicated below, one by one using a wire bar coater at 55° C., and then dried.

| | |
|---|---|
| Gelatin | 80 mg/m$^2$ |
| Dye Dispersion B (as dye solid part) | 8 mg/m$^2$ |
| Coating Aid-VI | 1.8 mg/m$^2$ |
| Compound-VII | 0.27 mg/m$^2$ |
| Matting Agent (polymethyl methacrylate having an average particle size of 2.5 μm) | 2.5 mg/m$^2$ |
| Coating Aid-VI | |
| $C_{12}H_{25}O(CH_2CH_2O)_{10}H$ | |
| Compound-VII | 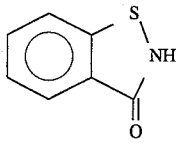 |

Preparation of Photographic Material

On both surfaces of the above prepared support, the aforementioned emulsion layer and the surface protective layer were coated by a double extrusion method to obtain Comparative Sample 301.

Samples 311 to 314 of the present invention were prepared in the same manner as the preparation of Sample 301 except for replacing Sensitizing Dye-I in the comparative sample with the compounds represented by formula (I) of the present invention. The coated silver amount per one side was 1.75 g/m$^2$.

Evaluation of Photographic Performance

Both sides of the photographic material were closely contacted with GRENEX Orthoscreen HR-4 (a product of Fuji Photo Film Co., Ltd.) using a cassette and exposed for 0.05 sec from both sides and X-ray sensitometry was carried out. The adjustment of the exposure amount was conducted by changing the distance between X-ray bulb and the cassette. After exposure, the photographic material was processed using the following developing solution and the fixing solution by an automatic processor.

Automatic Processor

Processing was carried out so that the total processing time was 30 sec using Fuji X-Ray Processor CEPROS-30 (a product of Fuji Photo Film Co., Ltd.). The blowoff temperature for drying was set at 55° C.

The compositions of the developing solution and the fixing solution are shown below. Sample 301 was running processed using these processing solutions with 20 ml per one quarter size (258 ml/m$^2$) and running processing solution was produced.

Developing Solution

| Part A | |
|---|---|
| Potassium Hydroxide | 18.0 g |
| Potassium Sulfite | 75.0 g |
| Sodium Carbonate | 30.0 g |
| Boric Acid | 5.0 g |
| Diethylene Glycol | 10.0 g |

-continued

| | |
|---|---|
| Diethylenetriaminepentaacetic Acid | 2.0 g |
| 1-(N,N-Diethylamino)ethyl-5-mercaptotetrazole | 0.1 g |
| Hydroquinone | 27.0 g |
| 4-Hydroxymethyl-4-methyl-1-phenyl-3-pyrazolidone | 2.0 g |
| Water to make | 300 ml |
| Part B | |
| Triethylene Glycol | 45.0 g |
| 3,3'-Dithiobishydrocinnamic Acid | 0.2 g |
| Glacial Acetic Acid | 5.0 g |
| 5-Nitroindazole | 0.3 g |
| 1-Phenyl-3-pyrazolidone | 3.5 g |
| Water to make | 60 ml |
| Part C | |
| Glutaraldehyde (50%) | 10.0 g |
| Potassium Bromide | 1.0 g |
| Potassium Metabisulfite | 10.0 g |
| Water to make | 50 ml |

Water was added to 300 ml of Part A, 60 ml of Part B and 50 ml of Part C to make 1 liter and pH was adjusted to 10.50.

Fixing Solution

| | |
|---|---|
| Ammonium Thiosulfate (70 wt/vol %) | 200 ml |
| Disodium Ethylenediaminetetraacetate Dihydrate | 0.03 g |
| Sodium Sulfite | 15.0 g |
| Boric Acid | 4.0 g |
| 1-(N,N-Dimethylamino)ethyl-5-mercaptotetrazole | 1.0 g |
| Tartaric Acid | 3.0 g |
| Sodium Hydroxide | 15.0 g |
| Sulfuric Acid (36 N) | 3.9 g |
| Aluminum Sulfate | 10.0 g |
| Water to make | 1 liter |
| pH (adjusted to 4.60) | |

Evaluation of Residual Color

The photographic material was cut to a size of 30.5 cm×25.4 cm and processed by the above running processing solution with washing water being 5° C., and the residual color of the photographic material was visually evaluated according to the following standard. The results obtained are shown in Table 15.

⊙: There remains almost no color.

o: A trace amount of residual color is obserbed but is negligible.

Δ: There remains a color but is admittable in practice.

x: The residual color is extreme and impracticable.

TABLE 15

| Sample No. | Residual Color | Sensitizing | Sensitizing Dye* | Remarks |
|---|---|---|---|---|
| 301 | Δ | 100 | Sensitizing Dye-I | Comparison |
| 311 | ⊙ | 99 | 1–11 | Invention |
| 312 | ⊙ | 100 | 1–12 | " |
| 313 | ⊙ | 99 | 1–14 | " |
| 314 | ⊙ | 101 | 1–24 | " |

*Addition amounts were equimolar with the comparative sample.

The photographic material using the sensitizing dye of the present invention scarcely provided a residual color and exhibited excellent performances compared with the photographic material using the conventional desensitizing dyes, even when they were processed while the replenisher amount was diminished.

EXAMPLE 4

An aqueous solution of gelatin containing $1.5\times10^{-4}$ mol/liter of 1,3-dimethyl-2-imidazolidinethione and $7\times10^{-2}$ mol/liter of sodium chloride was maintained at 40° C., and a mixed aqueous solution of sodium chloride and sodium bromide (containing $2\times10^{-7}$ mol of potassium hexachloroiridium(III) and $3\times10^{-7}$ mol of ammonium hexachlororhodium(III), respectively, per mol of silver) and an aqueous solution of silver nitrate were added thereto by a double jet method over 30 minutes to obtain a monodisperse cubic silver chlorobromide emulsion (the content of silver bromide: 30 mol%) having an average grain size of 0.25 μm was obtained.

After the termination of the grain formation, the emulsion was washed with water by an ordinary method and soluble salts were removed, then gelatin was added and further sodium chloride, sodium bromide, and sodium hydroxide were added to adjust the pAg and the pH to 7.5 and 6.0, respectively. $2\times10^{-5}$ mol per mol of silver of sodium thiosulfate and $3\times10^{-5}$ mol per mol of silver of potassium chloroaurate were added to the emulsion and chemically sensitized at 60° C. for 40 minutes.

After chemical sensitization, $1\times10^{-3}$ mol per mol of silver of 4-hydroxy-6-methyl-l,3,3a,7-tetraazaindene was added to thereby obtain Emulsion A.

The sensitizing dyes of the present invention and comparative Dye (a) shown below were added to Emulsion A in an amount of $3.5\times10^{-4}$ mol per mol of silver, respectively.

Comparative Dye (a)

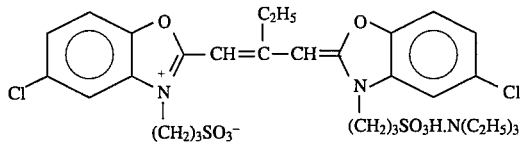

Further, Hydrazine Compound (b) having the following structural formula was added.

Hydrazine Compound (b)

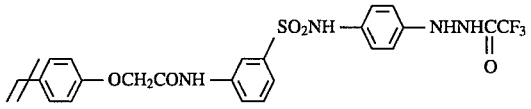

Compound (c) as a high contrast accelerator was added to each emulsion in an amount of $4\times10^{-3}$ mol per mol of silver.

High Contrast Accelerator (c)

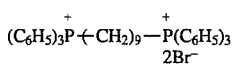

Further, $4\times10^{-4}$ mol per mol of silver of Mercapto Compound (d), $1\times10^{-3}$ mol per mol of silver of 5-methylbenzotriazole, 0.8 g per $m^2$ of the photographic material of the polyethyl acrylate compound as disclosed in Preparation Formulation 3 of U.S. Pat. No. 3,525,620 as polymer latex, 40 mg per $m^2$ of the photographic material of sodium p-dodecylbenzenesulfonate as a coating aid, and 100 mg per $m^2$ of the photographic material of 1,3-divinylsulfonyl-2-propanol as a hardening agent, so that each coating amount became to indicated amounts, were added to each emulsion. The prepared emulsion was coated so that the coated silver amount became 3.2 g per $m^2$ on an undercoated polyethylene terephthalate support provided with a dye layer having an absorption range from blue to green light on the back side.

Mercapto Compound (d)

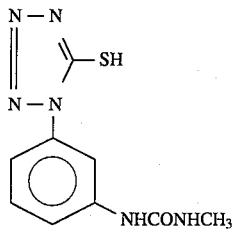

A gelatin protective layer was coated as an uppermost layer on the silver halide emulsion layers. The amount of gelatin of the protective layer was designed to become 1.2 g per $m^2$ of the photographic material. Further, 40 mg/$m^2$ of amorphous $SiO_2$ having average grain size of 3.5 μm as a matting agent, 20 mg/$m^2$ of silicone oil 60 mg/$m^2$ of sodium p-dodecylbenzenesulfonate as a coating aid, and 5 mg/$m^2$ of Fluorine Based Surfactant (e) were contained in the protective layer.

Fluorine Based Surfactant (e)

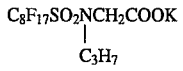

Thus, Comparative Sample 401 and Samples 411 to 414 of the present invention as indicated in Table 16 were prepared.

After each sample was stored in an air-conditioned room of 40° C. and 60% RH for one day, subjected to exposure to a tungsten light of 3,200° K. for 5 seconds through an optical wedge for sensitometry, and development processed by the following composition (1) at 34° C. for 20 seconds.

FG-710F processor of Fuji Photo Film Co., Ltd. was used in development.

FR-F1 (manufactured by Fuji Photo Film Co., Ltd.) was used as the fixing solution.

Developing Solution Composition (1)

| | |
|---|---|
| Hydroquinone | 30.0 g |
| 4-Methyl-4-hydroxymethyl-1-phenyl-3-pyrazolidone | 1.2 g |
| Diethylenetriaminepentaacetic Acid | 2.0 g |
| Diethylene Glycol | 40.0 g |
| Boric Acid | 10.0 g |
| Potassium Sulfite | 85.0 g |
| Sodium Bromide | 6.0 g |
| 5-Methylbenzotriazole | 0.2 g |
| 1-Phenyl-5-mercaptotetrazole | 20 mg |
| Potassium Carbonate | 20.0 g |
| Sodium Hydroxide and Water to make and pH was adjusted to 10.5 | 1 liter |

The results obtained are shown in Table 16.

Here, the reciprocal of the exposure amount providing a density of 1.5 was taken as the sensitivity and is expressed by a relative value. As the standard indicating the contrast of images, the gradient of the straight line joining the points of fog+density 0.3 and fog+density 3.0 on the characteristic curve was taken as gamma (γ) value. That is, γ=(3.0–0.3)/[log(exposure amount providing a density of 3.0)–log(exposure amount providing a density of 0.3)], and the larger gamma value shows higher contrast photographic characteristics.

A: Very beautiful and the same level with the sample which does not contain a dye.

B: Very little stain is observed.

C: A little coloring is observed.

D: A considerable coloring is observed.

E: Extreme coloring is observed.

Evaluation was conducted according to the above ranking.

TABLE 16

| Sample No. | Sensitizing Dye | Sensitivity | γ (Gamma) | Residual Color | Remarks |
|---|---|---|---|---|---|
| 401 | a | 100 | 18.8 | D | Comparison |
| 411 | 1–11 | 99 | 19.1 | B | Invention |
| 412 | 1–12 | 100 | 19.0 | B | Invention |
| 413 | 1–14 | 100 | 20.1 | A | Invention |
| 414 | 1–24 | 100 | 18.9 | C | Invention |

The photographic material using the sensitizing dye of the present invention has the same level in sensitivity and gradation as that of the comparative photographic material, but the residual color of the former is less than that of the latter.

EXAMPLE 5

An aqueous solution of silver nitrate and a mixed aqueous solution of potassium bromide and potassium chloride containing $1.5\times10^{-7}$ mol per mol of silver of potassium pentachloroaquarhodium(III) and $2\times10^{-7}$ mol per mol of silver of potassium hexachloroiridium(III) were added to an aqueous solution of gelatin containing 1,3-dimethyl-2-imidazolidinethione by a double jet method, and silver chlorobromide emulsion having an average grain size of 0.22 μm and a silver chloride content of 70 mol% was obtained. An aqueous solution containing $1\times10^{-3}$ mol per mol of silver of potassium iodide was added to the emulsion and conversion was carried out, then the emulsion was washed with a flocculation method and a methanol solution of each of the sensitizing dyes of the present invention and Comparative Compounds C-1 to C-4 was added.

Subsequently, an aqueous solution of gelatin was added thereto to adjust pH and pAg to 5.9 and 7.3, respectively, then sodium benzenesulfonate, benzenesulfinic acid, sodium thiosulfate pentahydrate and chloroauric acid were added thereto and heated at 60° C. for 45 minutes and chemical sensitization was conducted. 150 mg of 4-hydroxy-6-methyltetraazaindene as a stabilizer and 100 mg of Proxel as a preservative were added.

The thus prepared silver halide emulsion was coated on a polyethylene terephthalate film support which had been subjected to antistatic treatment. The sample was subjected to optical wedge exposure by a xenon lamp for $10^{-6}$ sec and processed using SR-D1 as a developing solution, GR-F1 as a fixing solution (both products of Fuji Photo film Co., Ltd.) by FG-680A automatic processor of Fuji Photo film Co., Ltd. at 35° C. for 30 sec. The density of the development processed sample was measured by a densitometer made by Fuji Photo Film Co., Ltd. and white light sensitivity and fog were determined. The standard point of the optical density determined the sensitivity was the point of [fog+0.3]. Further, sensitivity was expressed by relative sensitivity based on 100 (standard).

Samples for determining the residual color were not exposed and those processed by the above processor similarly were used. Samples were measured for the absorbing rate at the maximum absorption wavelength in the remaining sensitizing dye using a color analyzer 607 type of Hitachi, Ltd. by reflection measuring method.

The results obtained and-the comparative compounds are shown below.

TABLE 17

| Sample No. | Compound | Addition Amount $10^{-4}$ mol/mol Ag | Sensitivity | Fog | Residual Color Absorbing Rate | Remarks |
|---|---|---|---|---|---|---|
| 501 | C-1 | 2.2 | 100 | 0.25 | 0.16 | Comparison |
| 502 | C-2 | 2.2 | 82 | 0.27 | 0.08 | " |
| 503 | C-3 | 2.2 | 108 | 0.15 | 0.09 | " |
| 504 | C-4 | 2.2 | 75 | 0.12 | 0.06 | " |
| 511 | 1–15 | 2.2 | 110 | 0.10 | 0.04 | Invention |
| 512 | 1–28 | 2.2 | 113 | 0.08 | 0.04 | " |

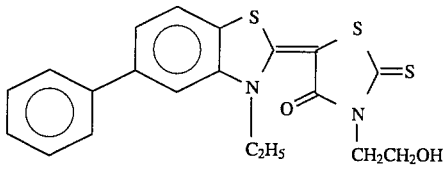

C-1

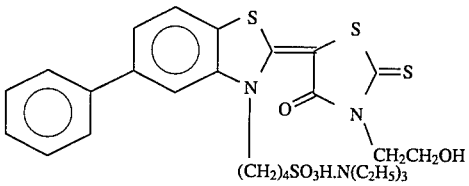

C-2

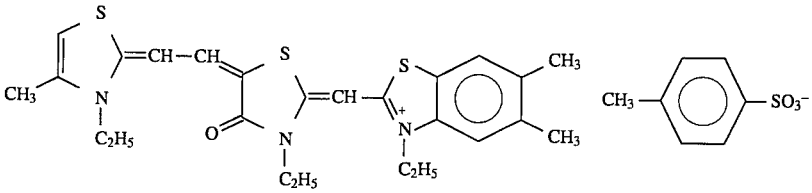

C-3

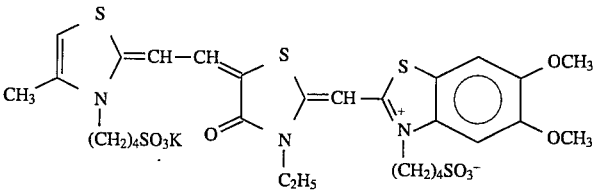

C-4

From the results shown in Table 17, it can be seen that the present invention provides high sensitivity, less residual color and the reduced fog.

(The residual color is preferably 0.09 or less in the values in the table, and if it exceeds this value, a residual color can be seen by a careful observation and is not suitable as a commercial product. If the value exceeds 0.1, it is judged to be extreme residual color.)

While the invention has been described in detail and with reference to specific examples thereof, it will be apparent to one skilled in the art that various changes and modifications can be made therein without departing from the spirit and scope thereof.

What is claimed is:

1. A silver halide photographic material which comprises a light sensitive silver halide emulsion and a methine compound represented by the following formula (I):

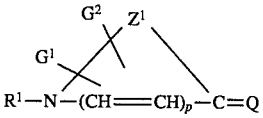

(I)

wherein $Z^1$ represents a nonmetal atomic group necessary for completing a 5- or 6-membered heterocyclic ring which may be condensed; $R^1$ represents an aliphatic or aromatic group which may be substituted; $G^1$ represents a hydroxyl group, an amino group, an aliphatic or aromatic primary amino group, a hydroxyamino group, an alkoxyamino group, an acylamino group or an aliphatic or aromatic sulfonamido group; $G^2$ is a group substituted at the position adjacent to $G^1$ and is a group represented by $T^2—C(=T^1)—$; $=T^1$ represents =O, =NH, =NOH, an alkoxyimino group, an aliphatic or aromatic imino group, an acylimino group, or an aliphatic or aromatic sulfonylimino group; $T^2$ represents a hydrogen atom, an alkyl group, an aryl group, an alkoxy group, an aryloxy group, an amino group, a primary or secondary amino group, a carbonamido group, an aliphatic or aromatic sulfonamido group or a ureido group; p represents 0 or 1; and Q represents a residue for forming a methine dye.

2. A silver halide photographic material as claimed in claim 1, wherein Q is represents by formula (II), (III) or (IV):

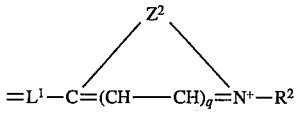

(II)

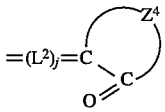

(III)

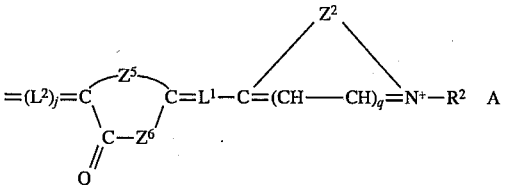

(IV)

wherein $Z^2$ represents a nonmetal atomic group necessary for completing a 5- or 6-membered heterocyclic ring which may be condensed; $Z^4$ represents a nonmetal atomic group necessary for forming a 5- or 6-membered ring together with (C—C=O); $Z^5$ and $Z^6$ each represents a nonmetal atomic group necessary for completing a 5- or 6-membered ring together with (C—C=O) and C; q represents 0 or 1; $L^1$ represents a methine group which may be substituted, or a trivalent group obtained by making 3, 5 or 7 methine groups link by conjugated double bonding; $L^2$ represents a tetravalent group obtained by making 2, 4 or 6 methine groups link to form conjugated double bonding which may be substituted; $R^2$ represents an aromatic group which may be substituted or an aliphatic group which may be substituted; j represents 0 or 1; A represents a counter ion, in the case of necessity.

3. A silver halide photographic material as claimed in claim 1, wherein formula (I) is represented by the following formula (I-A):

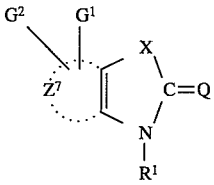

(I-A)

wherein $R^1$, Q, $G^1$ and $G^2$ each has the same meaning as in formula (I); X represents —S—, >N—$R^3$ or —O—; $R^3$ has the same meaning as $R^1$; $Z^7$ represents an atomic group necessary for forming a benzene ring or a naphthalene ring.

4. A silver halide photographic material as claimed in claim 2, wherein formula (I) is represented by the following formula (I-A):

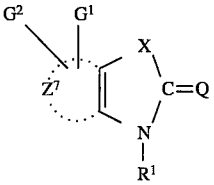

(I-A)

wherein $R^1$, Q, $G^1$ and $G^2$ each has the same meaning as in formula (I); X represents —S—, >N—$R^3$ or —O—; $R^3$ has the same meaning as $R^1$; $Z^7$ represents an atomic group necessary for forming a benzene ring or a naphthalene ring.

* * * * *